US010124574B2

(12) United States Patent
Ono

(10) Patent No.: US 10,124,574 B2
(45) Date of Patent: Nov. 13, 2018

(54) INFORMATION PROCESSING EQUIPMENT AND COMPUTER-READABLE RECORDING MEDIUM FOR PRESSING MULTIPLE COLORS OF METAL LEAF

(71) Applicant: Konica Minolta, Inc., Chiyoda-ku, Tokyo (JP)

(72) Inventor: Koichi Ono, Kasukabe (JP)

(73) Assignee: KONICA MINOLTA, INC., Chiyoda-ku, Tokyo (JP)

( * ) Notice: Subject to any disclaimer, the term of this patent is extended or adjusted under 35 U.S.C. 154(b) by 0 days.

(21) Appl. No.: 15/697,710

(22) Filed: Sep. 7, 2017

(65) Prior Publication Data

US 2018/0099498 A1 Apr. 12, 2018

(30) Foreign Application Priority Data

Oct. 12, 2016 (JP) ..... 2016-200676

(51) Int. Cl.

| | |
|---|---|
| ***B44C 1/14*** | (2006.01) |
| ***B41F 19/06*** | (2006.01) |
| ***B41F 19/00*** | (2006.01) |
| ***B41F 33/00*** | (2006.01) |

(52) U.S. Cl.

CPC ..... *B41F 19/062* (2013.01); *B41F 19/00* (2013.01); *B41F 19/004* (2013.01); *B41F 33/00* (2013.01); *B41P 2213/91* (2013.01); *B41P 2219/20* (2013.01); *B41P 2219/42* (2013.01); *B41P 2219/60* (2013.01)

(58) Field of Classification Search

CPC ..... B41F 19/062; B41P 2219/20; G06K 15/1885; G06K 15/1889; H04N 5/2628; B44C 1/14; B44C 1/145

USPC ..... 358/1.9, 1.5, 3.26, 1.12, 1.18

See application file for complete search history.

(56) References Cited

U.S. PATENT DOCUMENTS 6,885,776 B2 * 4/2005 Takakura ..... G06T 3/4038 345/629

2013/0000830 A1 * 1/2013 Green ..... B44C 1/14 156/233

FOREIGN PATENT DOCUMENTS

JP 2006-224667 A 8/2006

* cited by examiner

*Primary Examiner* — Jamares Q Washington

(74) *Attorney, Agent, or Firm* — Squire Patton Boggs (US) LLP

(57) ABSTRACT

According to one aspect of the present invention, when there is no leaf object striding over a boundary of two leaf rolls in a leaf image, a leaf image generating section performs processing for dividing first leaf image in first print data for leaves and a second leaf image of second print data for leaves at the boundary, replacing one of divided leaf images with one of other divided leaf images that hold the boundary between the first leaf image and the second leaf image to generate a first combined-leaves image and a second combined-leaves image, and rotating the second combined-leaves image at a predetermined angle.

15 Claims, 32 Drawing Sheets

INFORMATION PROCESSING EQUIPMENT AND COMPUTER-READABLE RECORDING MEDIUM FOR PRESSING MULTIPLE COLORS OF METAL LEAF

BACKGROUND OF THE INVENTION

Field of the Invention

The present invention relates to an information processing equipment and a computer-readable recording medium that generate print data for leaves for leaf pressing processing.

Description of the Related Art

Conventionally, leaf pressing print has been known for forming characters and designs made of leaves of gold, silver, and the like, on a sheet. Leaf pressing print is performed by applying adhesive material such as varnish on the sheet, and bonding a metal thin film (leaf) with a point where the adhesive material is applied.

Here, with reference to FIGS. 1 and 2, a print system including a conventional leaf pressing machine will be described. FIG. 1 is a schematic view illustrating an entire construction of the print system including a conventional leaf pressing machine. FIG. 2 illustrates conventional leaf pressing print (when a leaf object does not stride over a boundary).

According to the conventional leaf pressing print, when print data (submitted data 5) including a gold leaf image and a silver leaf image is submitted from a client terminal 1, the submitted data 5 is divided by a controller 2 into three kinds of print data 6 without leaves excluding a gold or a silver leaf object (also referred to as a "leaf pressed image"), print data 7*g* for gold leaves including a gold leaf object, and print data 7*s* for silver leaves including a silver leaf object.

Subsequently, the print data 6 without leaves is printed by a printer 3, and a user sets printed matter 8 in a leaf pressing machine 4. Since only one kind of leaf pressing can be performed by a general leaf pressing machine 4, a gold leaf roll is set in the leaf pressing machine 4 first, and the leaf pressing machine 4 performs additional print (leaf pressing) on the printed matter 8 based on the print data 7*g* for gold leaves. Subsequently, a silver color leaf roll is set in the leaf pressing machine 4, and the leaf pressing machine 4 performs the additional print (leaf pressing) based on print data 7*s* for silver leaves to create printed matter 9 on which the gold leaf and the silver leaf are pressed.

Further, in recent years, a leaf pressing machine that can mount two leaf rolls has been developed. As illustrated in FIG. 2, two leaf rolls in different colors are arranged adjacent to each other in a vertical direction with respect to a sheet forwarding direction. A boundary C is a boundary part between a gold leaf region 11*g* (one example of first region) where the leaf pressing processing is performed with a gold leaf roll 10*g* (first leaf roll), and a silver leaf region 11*s* (one example of second region) where the leaf pressing processing is performed with a silver leaf roll 10*s* (second leaf roll), and corresponds to a center of a leaf image 12 of the submitted data. Such a leaf pressing machine mounting two leaf rolls can press the gold leaf and the silver leaf at a time, if a leaf image 12 includes a gold leaf object 13*g* and a silver leaf object 13*s* that are located at a left side and a right side respectively holding the boundary C between the gold leaf object 13*g* and the silver leaf object 13*s* as illustrated in FIG. 2.

Patent Literature 1 discloses constructions of a rotational drive section, a bearing device, a winding axis, and the like, to keep stopping a partial leaf roll that does not perform the leaf pressing, in a device provided with a partial leaf roll sending a partial leaf row obtained by dividing a transfer leaf into one or more.

RELATED ART DOCUMENT

Patent Document

Patent Literature 1: Japanese Laid-Open Patent Publication No. 2006-224667

SUMMARY OF THE INVENTION

Problem to be Solved by the Invention

FIG. 3 illustrates a conventional leaf pressing print (when the leaf object strides over the boundary). As illustrated in FIG. 3, when a leaf image 14 includes a gold leaf objet 15*g* and a silver leaf object 15*s* striding over the boundary C, even the above-described leaf pressing machine mounting the two leaf rolls cannot complete the leaf pressing processing at a time. Therefore, the gold leaf roll and the silver leaf roll that are longer than the conventional leaf image 14 in a width direction (vertical direction with respect to the sheet forwarding direction) need to be prepared, and two-time leaf pressing print needs to be performed while the gold leaf roll and the silver leaf roll are replaced with each other.

FIG. 4 illustrates submitted data dotted with a plurality of different leaf objects. In the submitted data 20 illustrated in FIG. 4, gold leaf objects (21*g*1, 21*g*2, 23*g*1), and silver leaf objects (21*s*1, 21*s*2, 22*s*1, 22*s*2, 23*s*1) are dotted right and left in an image. As illustrated in FIG. 4, also when the gold and silver leaf objects are scattered all over a sheet, since the above-described method cannot complete the leaf pressing print at a time, the leaf pressing print needs to be performed two times while the gold leaf roll and the silver leaf roll are replaced with each other as the conventional method.

Technique disclosed in Patent Literature 1 also needs much work for pressing the leaves in a plurality of colors, and Patent Literature 1 does not disclose a method of solving a problem of the above-described leaf pressing machine mounting the plurality of leaf rolls.

The present invention is conducted in consideration of the above-described states, and has an object to provide the leaf pressing machine mounting the plurality of leaf rolls that can perform the leaf pressing print without replacing the leaf rolls, even when two or more leaf objects are dotted all over the image in the submitted data.

Means for Solving the Problem

An information processing equipment of an aspect of the present invention includes a stride-over determining section and a print data for combined leaves generating section. The stride-over determining section extracts leaf objects from first print data for leaves including a first leaf image including only a leaf object in a first color and second print data for leaves including a second leaf image including only a leaf object in a second color that are formed on a sheet by leaf pressing processing performed by a leaf pressing machine in which a first leaf roll in the first color and a second leaf roll in the second color are arranged adjacent to each other in a vertical direction with respect to a sheet forwarding direction, and determines whether or not there is a leaf object striding over a boundary between a first region where the leaf pressing processing is performed with the first leaf roll and a second region where the leaf pressing processing is performed with the second leaf roll.

A print data for combined leaves generating section, when the stride-over determining section determines that there is no leaf object striding over the boundary, performs processing for dividing each of the first leaf image in the first print data for leaves and the second leaf image in the second print data for leaves at the boundary, and replacing one of divided leaf images with one of other divided leaf images that hold the boundary between the first leaf image and the second leaf image to generate a first combined-leaves image and a second combined-leaves image and also performs processing for rotating the second combined-leaves image at a predetermined angle, so as to generate first print data for combined leaves including the first combined-leaves image, and second print data for combined leaves including the second combined-leaves image after being rotated.

The problem, construction, and effect other than described above will be clarified by embodiments described below.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Figure 1:
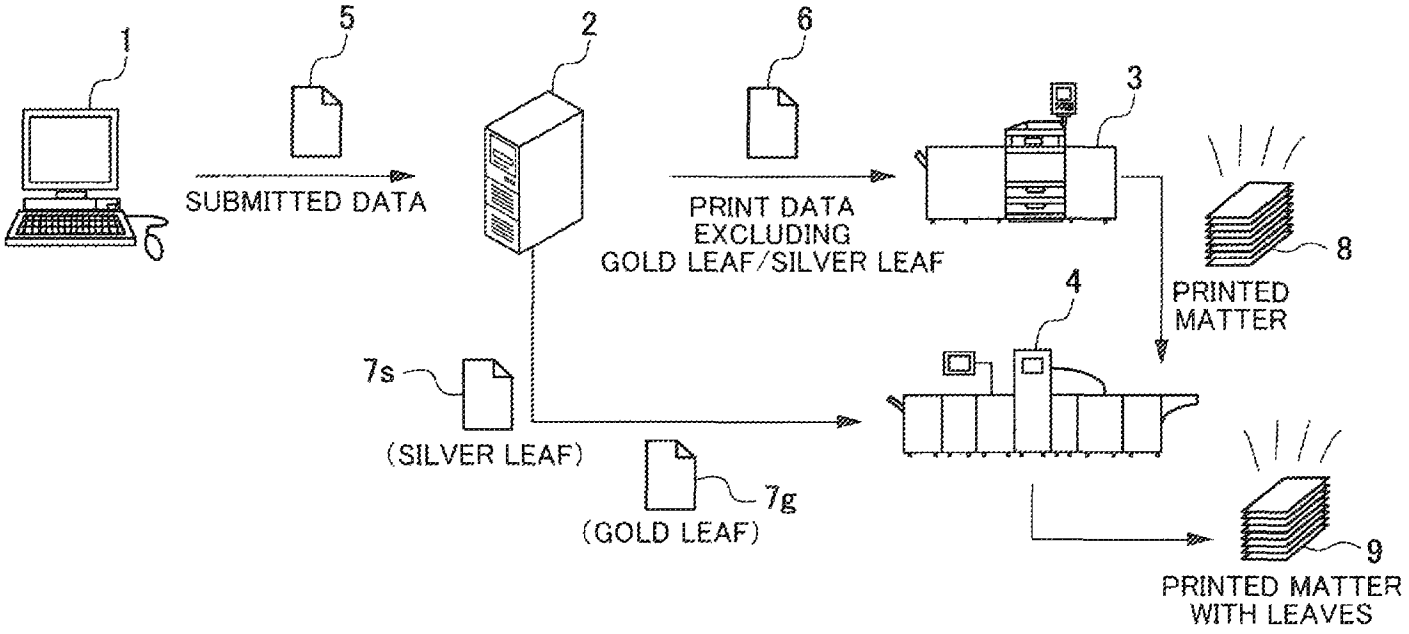
FIG. 1 is a schematic view illustrating an entire construction of a print system including a conventional leaf pressing machine.

Hereinafter, an embodiment of the present invention will be described with reference to the drawings. However, the scope of the invention is not limited to the illustrated examples.

With reference to the attached drawings, embodiments for conducting the present invention will be described below. The embodiments will be described in order described below. Note that constituent elements having substantially the same functions or configurations in each figure are given the same reference numerals and duplicated explanation will be omitted.

1. First Embodiment (example in which divided leaf images of leaf images in different colors are replaced with each other)
2. Second Embodiment (example in which the boundary is not located at a center of a leaf sheet)
3. Third Embodiment (multiple imposition, arrangement change, shift, center rotation)
4. Fourth Embodiment (example in which the leaf pressing machine mounts three leaf rolls)
5. Fifth Embodiment (rotation angle of the leaf image in one of print data for leaves)
6. Others <1. First Embodiment>

[Entire Construction of Print System]

Figure 5:
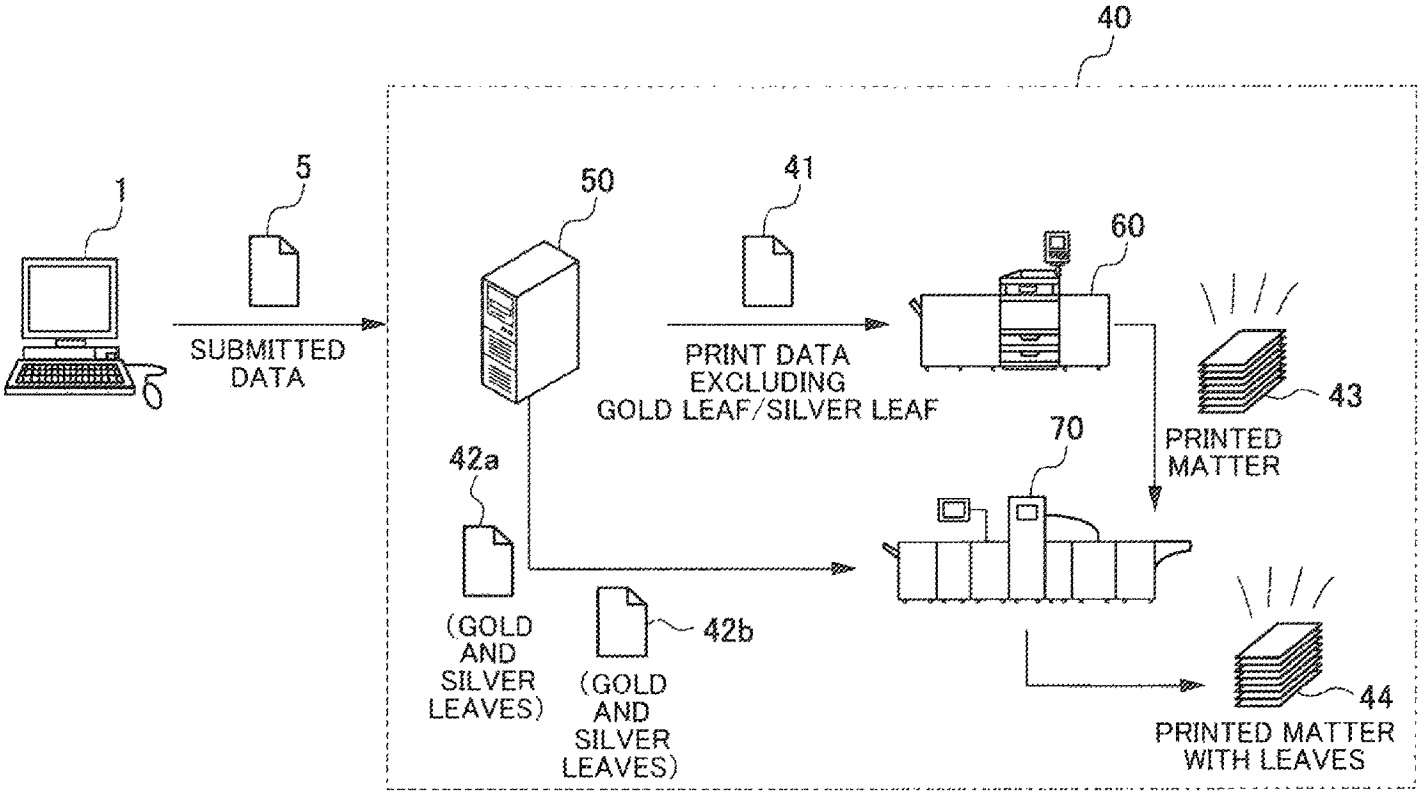
FIG. 5 is a schematic view illustrating an entire construction of the print system including the leaf pressing machine according to a first embodiment of the present invention.

FIG. 5 is a schematic view illustrating an entire construction of the print system including the leaf pressing machine according to the first embodiment.

Figure 2:
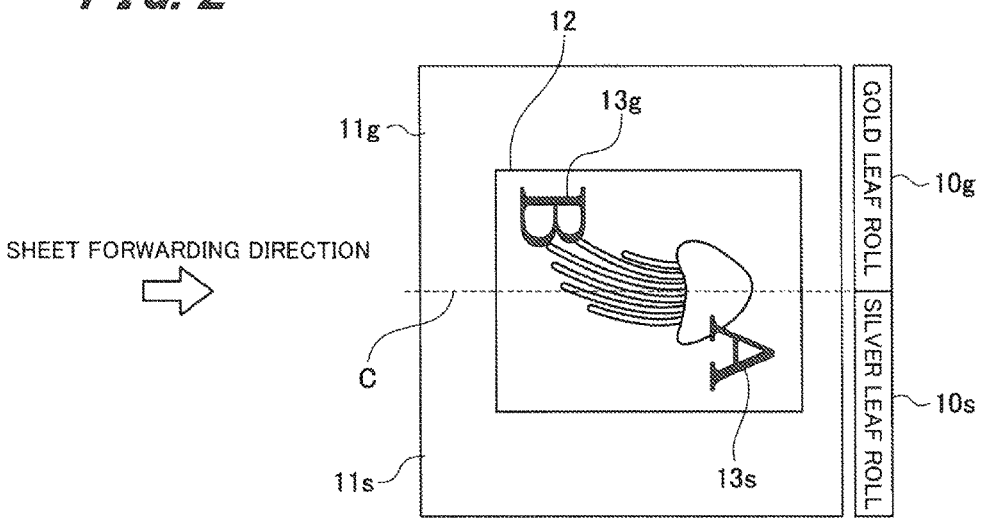
FIG. 2 illustrates conventional leaf pressing print (when a leaf object does not stride over a boundary)
Figure 3:
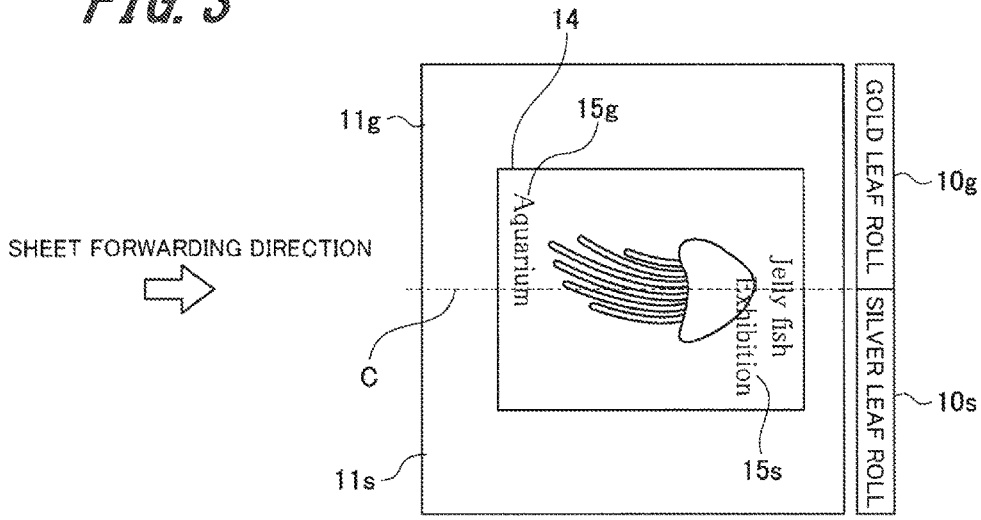
FIG. 3 illustrates the conventional leaf pressing print (when the leaf object strides over the boundary)
Figure 6:
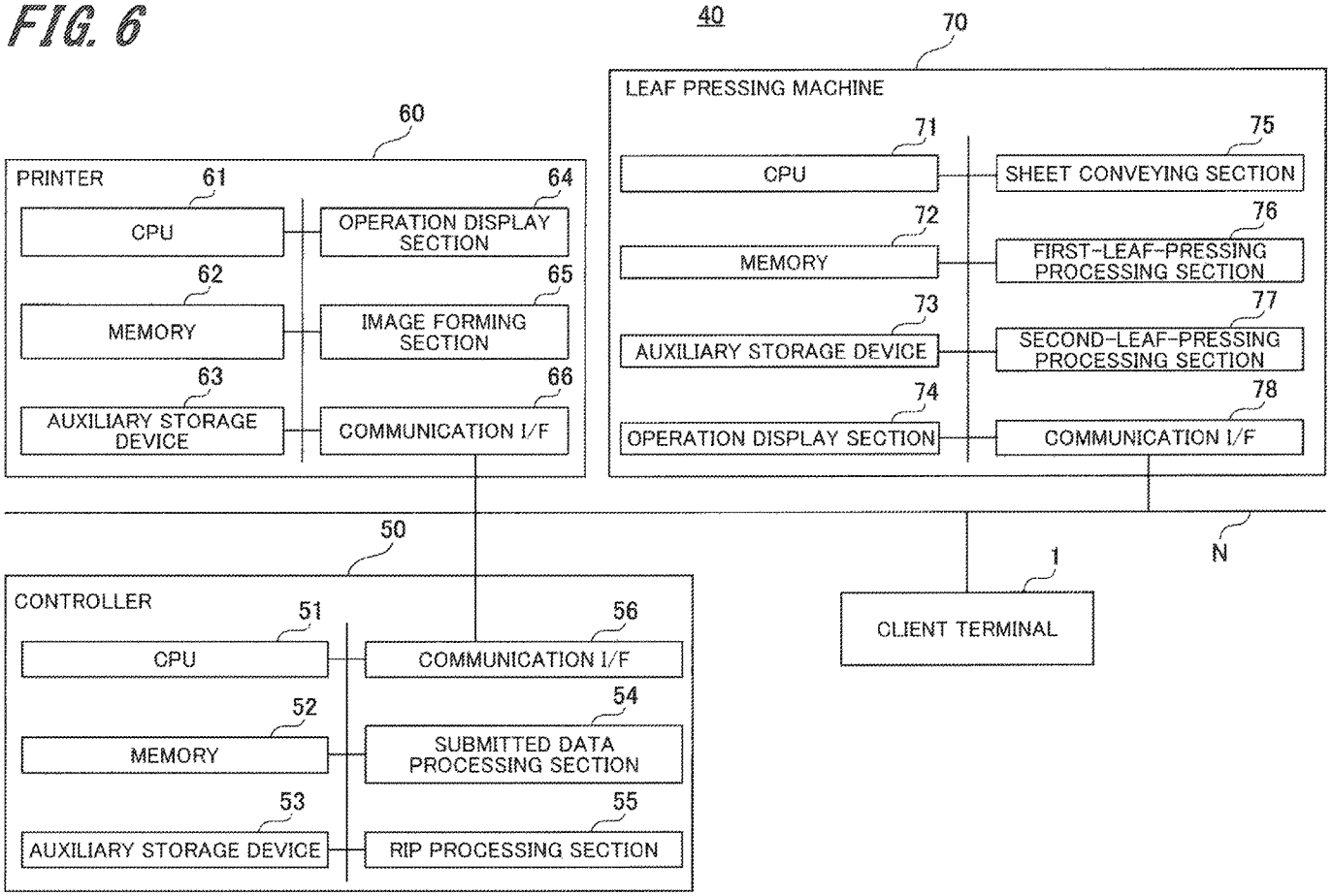
FIG. 6 is a block diagram illustrating a hardware construction of each device included in the print system according to the first embodiment of the present invention.

A print system 40 illustrated in FIG. 5 includes a controller 50, a printer 60, and a leaf pressing machine 70. The controller 50 (one example of information processing equipment), the printer 60, and the leaf pressing machine 70 are connected with each other via a network N (FIG. 6). The printer 60 has the similar function to that of the printer 3 illustrated in FIG. 1. Further, as illustrated in FIGS. 2 and 3, in the leaf pressing machine 70, the gold leaf roll 10*g* and the silver leaf roll 10*s* are arranged adjacent to each other in a vertical direction with respect to a sheet forwarding direction.

Figure 13:
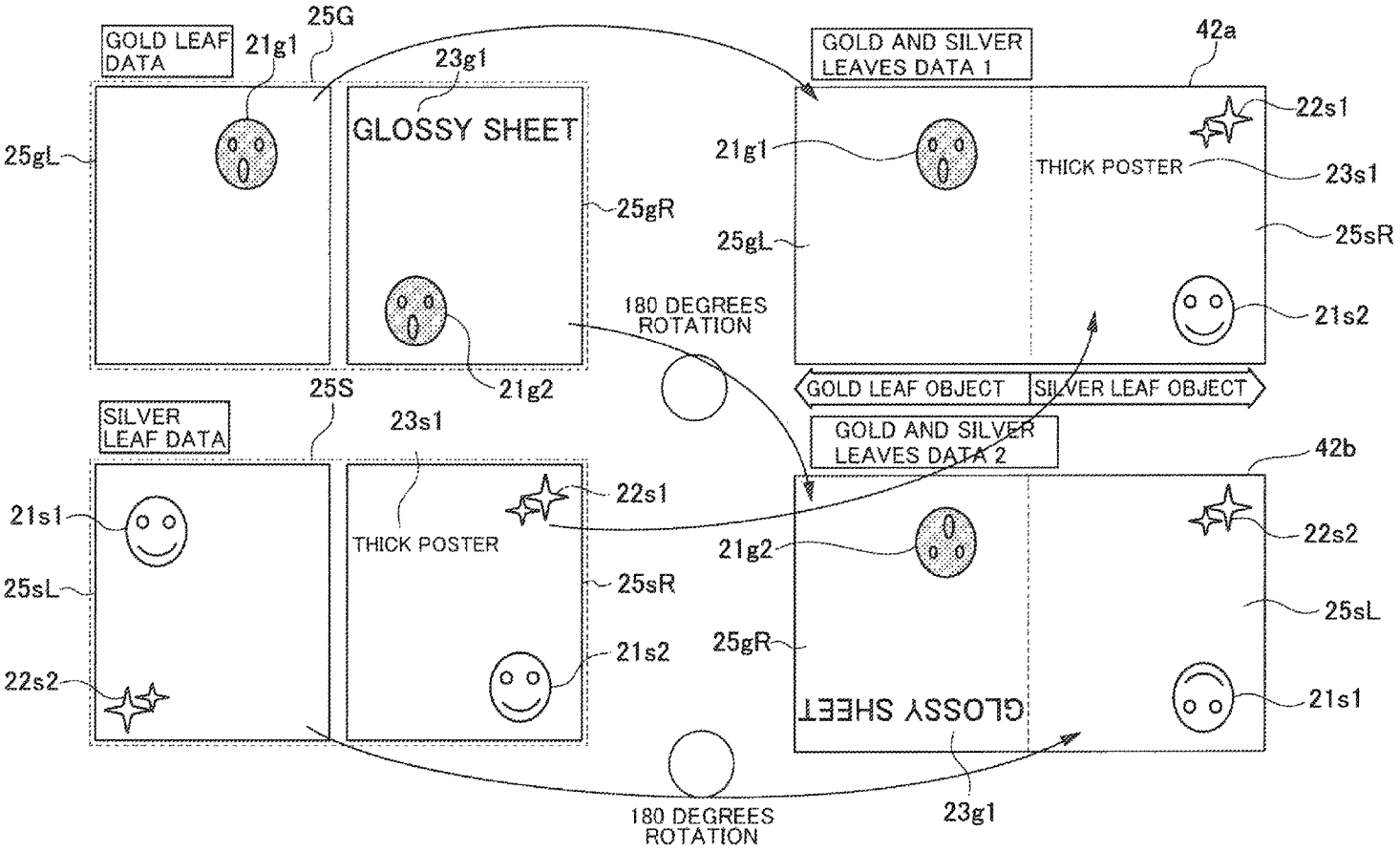
FIG. 13 illustrates a method of creating first print data for leaves and second print data for leaves, according to the first embodiment of the present invention.

The print data (submitted data 5) including a gold leaf image and a silver leaf image included in a print job is submitted from the client terminal 1 to the controller 50. The controller 50 generates print data 41 without leaves excluding the leaf image (leaf pressed image) that includes a gold leaf object and a silver leaf object, first print data 42*a* for combined leaves including the gold leaf object and the silver leaf object, and further second print data 42*b* for combined leaves including the gold leaf object and the silver leaf object, from the submitted data 5. With reference to FIG. 13, the first print data 42*a* for combined leaves and the second print data 42*b* for combined leaves will be described in detail below. The print data (submitted data) input in the present embodiment is image data without the leaf image or with the leaf image.

The print data 41 without leaves is input into the printer 60, and the printer 60 performs the print processing based on the print data 6 without leaves. The user sets printed matter 43 in the leaf pressing machine 70. The leaf pressing machine 70 performs additional print (leaf pressing) on the printed matter 43 for a first time, based on the first print data 42*a* for combined leaves. Subsequently, the user sets again in the leaf pressing machine 70 the printed matter 43 on which the leaf pressing machine 70 has performed the additional print for the first time. Then, the leaf pressing machine 70 performs the additional print (leaf print) on the printed matter 43 for a second time, based on the second print data 42*b* for combined leaves. By performing such processing, printed matter 44 on which the gold leaf and the silver leaf are pressed is created.

According to the embodiment described below, an environment in which each device of the print system 40 is connected with each other via the network N, is described as an example. However, the print data may be input into the printer 60 and the leaf pressing machine 70 using a recording medium such as a USB (universal serial bus) memory.

[Hardware Construction of Each Device]

FIG. 6 is a block diagram illustrating a hardware construction of each device included in the print system 40.

A personal computer is adopted for the client terminal 1, for example. Based on user's input operation, the client terminal 1 generates image data for performing print with a document creating or image creating application. Further, the client terminal 1 has a function of generating a print job that includes print setting information (also referred to as a "job ticket") and the image data (print data), and outputting them to the controller 50. The print setting information includes information about presence or absence of leaf pressing print setting, page layout and the like.

(Controller)

As illustrated in FIG. 6, the controller 50 includes a CPU 51, a memory 52, an auxiliary storage device 53, a submitted data processing section 54, a RIP processing section 55, and a communication I/F 56 (one example of communication section). A personal computer or a server is adopted for the controller 50, for example.

The controller 50 includes the CPU (Central Processing Unit) 51, the memory 52 which is a volatile recording medium, and the auxiliary storage device 53 which is a non-volatile recording medium, which are connected with each other via a bus. Further, the controller 50 includes the submitted data processing section 54, the RIP processing section 55, and the communication I/F 56.

The CPU 51 is a central processing unit that performs control and operation processing of actions of each section in the controller 50. The CPU 51 reads from the auxiliary storage device 53 a program code of software for realizing each function according to the present embodiment, and performs the program code. Note that the controller 50 may include a processing unit such as an MPU (micro-processing unit) in place of the CPU 51.

The memory 52 is a main storage device, and variables, parameters and the like generated during operation processing are temporarily written into the memory 52. A RAM (random access memory) or the like is adopted for the memory 52.

The auxiliary storage device 53 is a storage device having an auxiliary role of the memory 52, and includes a system in which the data can be usually stored for long periods. As the auxiliary storage device 53, an HDD (hard disk drive), an SSD (solid state drive), a flexible disk, an optical disk, an optical magnetic disk, a CD-ROM, a CD-R, magnetic tape, a non-volatile memory card, and the like, are used. The auxiliary storage device 53 records, in addition to an OS (operating system) and various kinds of parameters, a program for functioning the controller 50. For example, the auxiliary storage device 53 may store a program (software) illustrated in FIGS. 8 to 10.

The submitted data processing section 54 processes the print data (submitted data) submitted to the controller 50. The submitted data processing section 54 generates the print data without leaves, the print data for leaves in each color from the submitted data and the like. The print data processed by the submitted data processing section 54 is supplied to RIP processing. The submitted data processing section 54 will be described in detail below.

The RIP processing section 55 reflects the print setting on the print data, converts the print data into a language (PDL; page description language) that can be recognized by the printer 60, and outputs it. The language that can be recognized by the printer 60 includes PCL, Post Script and the like. When the page layout setting is included, the RIP processing section 55 performs layout on the print data, based on the number of layouts and arrangement described in the page layout setting.

The communication I/F 56 uses an NIC or the like (network interface card), for example, is constructed to be able to transmit and receive various kinds of data among devices via the network N such as a LAN.

(Printer)

The printer 60 receives the print job output from the client terminal 1 via the network N, forms an image on a sheet, and outputs the image (hereinafter, referred to as "print processing"), based on the print setting and print data of the print job. The printer 60 may be an MFP (multi-function peripheral) having a plural kinds of functions (print function, copy function, scan function).

As illustrated in FIG. 6, the printer 60 includes a CPU 61, a memory 62, an auxiliary storage device 63, an operation display section 64, an image forming section 65, and a communication section I/F 66.

The CPU 61 is a central processing unit that performs control and operation processing of actions of each section in the printer 60. The CPU 61 reads from the auxiliary storage device 63 a program code of software for realizing each function according to the present embodiment, and performs the program code. Note that the printer 60 may include a processing unit such as the MPU in place of the CPU 61.

The memory 62 is a main storage device, and variables and parameters generated during the operation processing are temporarily written into the memory 62. The RAM or the like is adopted for the memory 62.

The auxiliary storage device 63 is a storage device having an auxiliary role of the memory 62, and includes a system usually being capable of storing the data for long periods. The auxiliary storage device 63 records, in addition to an OS and various kinds of parameters, a program for functioning the printer 60.

The operation display section 64 is constructed by layering touch panels that is an operation section, on a flat panel display that is a display section. The operation display section 64 generates an operation signal corresponding to content of an operation input by the user, and supplies the generated operation signal to the CPU 61. Further, the operation display section 64 displays a processing result of the CPU 61.

The image forming section 65 forms an image on a sheet, based on print data (print data without leaves) transmitted from the controller 50. The image forming section 65 is constructed as a printer engine.

The communication section I/F 66 uses the NIC or the like, for example, and is constructed to be able to transmit and receive various kinds of data among devices via the network N.

(Leaf Pressing Machine)

The leaf pressing machine 70 reads the print data for leaves in each color transmitted from the controller 50, applies varnish at a position of a sheet corresponding to each pixel of the leaf image included in the print data for leaves and, then, the leaves are bonded (leaf pressed) on the varnish.

As illustrated in FIG. 6, the leaf pressing machine 70 includes a CPU 71, a memory 72, an auxiliary storage device 73, an operation display unit 74, a sheet conveying section 75, a first-leaf-pressing processing section 76, a second-leaf-pressing processing section 77, and a communication section I/F 78.

The CPU 71 is a central processing unit that performs control and operation processing of action of each section in the leaf pressing machine 70. The CPU 71 reads from the auxiliary storage device 73 a program code of software for realizing each function according to the present embodiment and performs the program code. Note that the leaf pressing machine 70 may include a processing unit such as the MPU in place of the CPU 71.

The memory 72 is a main storage device, and variables and parameters generated during the operation processing are temporarily written into the memory 72. The RAM or the like is adopted for the memory 72.

The auxiliary storage device 73 is a storage device having an auxiliary role of the memory 72, and includes a system usually being capable of storing the data for long periods. The auxiliary storage device 73 records, in addition to OS and various kinds of parameters, a program for functioning the leaf pressing machine 70.

The operation display unit 74 is constructed by layering touch panels that are an operation section, on a flat panel display that is a display section. The operation display unit 74 generates an operation signal corresponding to content of an operation input by the user, and supplies the generated operation signal to the CPU 71. Further, the operation display unit 74 displays a processing result of the CPU 71.

The sheet conveying section 75 conveys a sheet set by the user in a manually feeding tray or a sheet-feeding tray of the leaf pressing machine 70 (both are not illustrated).

Based on the first print data for leaves including the gold leaf image (one example of a first leaf image) and the silver leaf image (one example of a second leaf image), the first-leaf-pressing processing section 76 applies the varnish on the sheet, and drives the gold leaf roll 10*g* to perform the leaf pressing so as to bond the gold leaf on the varnish.

Based on the second print data for leaves including the gold leaf image (one example of the first leaf image) and the silver leaf image (one example of the second leaf image), the second-leaf-pressing processing section 77 applies the varnish on the sheet, and drives the silver leaf roll 10*s* to perform the leaf pressing so as to bond the silver leaf on the varnish.

The communication section I/F 78 uses the NIC or the like, for example, and is constructed to be able to transmit and receive various kinds of data among devices via the network N.

[Control System of Controller]

Figure 7:
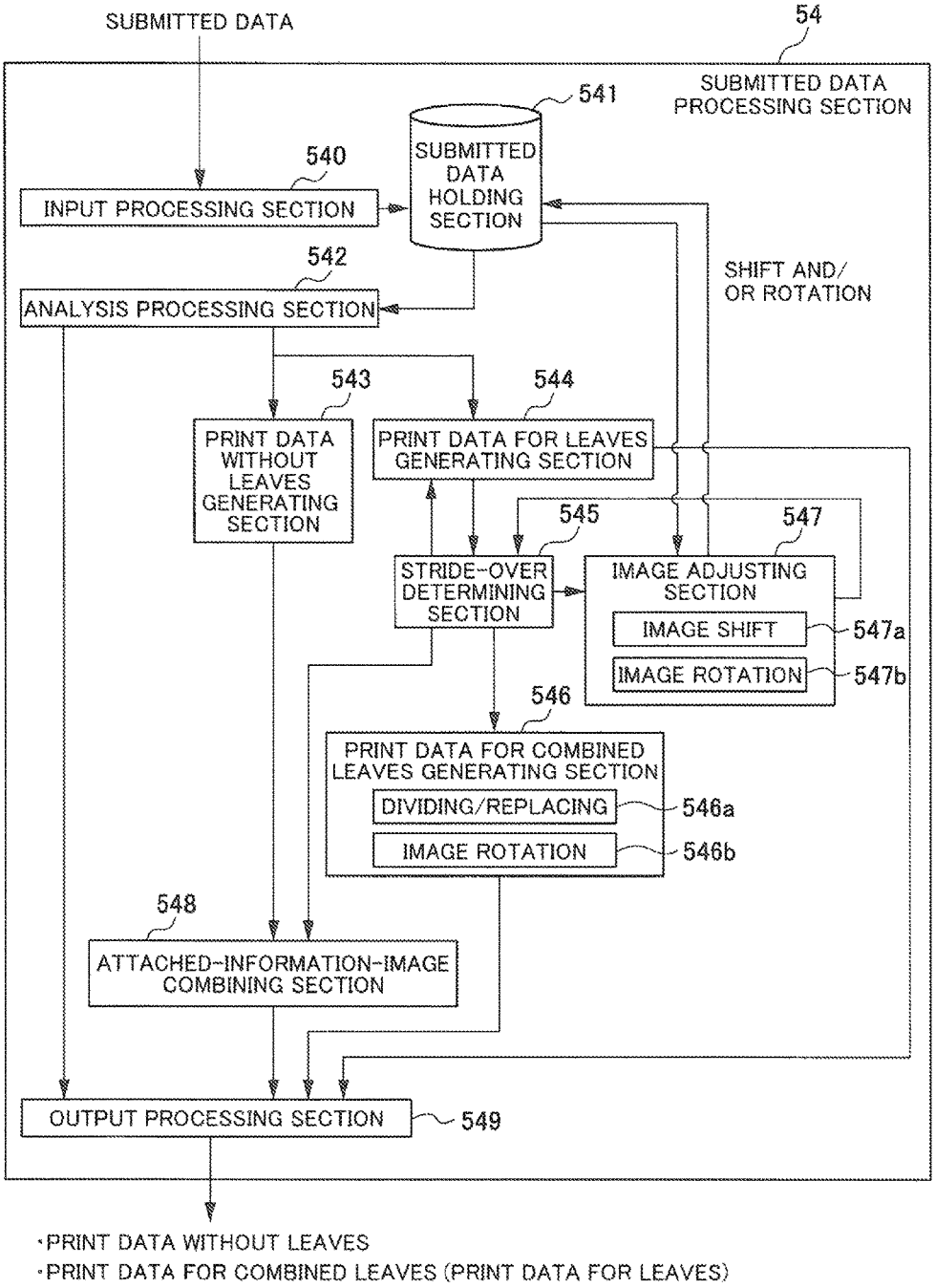
FIG. 7 is a block diagram illustrating a functional construction of a submitted data processing section of a controller according to the first embodiment of the present invention.

Subsequently, a functional construction of the submitted data processing section 54 in the controller 50 will be described. FIG. 7 is a block diagram illustrating a functional construction of the submitted data processing section in the controller 50.

The submitted data processing section 54 includes an input processing section 540, a submitted data holding section 541, an analysis processing section 542, a print data without leaves generating section 543, a print data for leaves generating section 544, a stride-over determining section 545, a print data for combined leaves generating section 546, an image adjusting section 547, an attached-information-image combining section 548, and an output processing section 549.

The input processing section 540 receives input of a print job including print setting information and print data, and supplies the print job to the submitted data holding section 541.

The submitted data holding section 541 temporarily holds the print job received by the input processing section 540.

The analysis processing section 542 reads the print job held by the submitted data holding section 541, and analyzes the print setting information included in the print job. When the print setting information includes leaf pressing print setting, the analysis processing section 542 determines that the submitted print data includes a leaf image. Alternatively, each pixel of the print data is scanned, and the analysis processing section 542 determines based on its result. When the submitted print data does not include the leaf image, the analysis processing section 542 supplies the print data to the output processing section as it is.

The print data without leaves generating section 543 generates print data without leaves excluding the gold leaf image and the silver leaf image from the submitted print data, and outputs the generated print data without leaves to the attached-information-image combining section 548.

The print data for leaves generating section 544 extracts first print data 25G for leaves (refer to FIG. 11) including the gold leaf image and second print data 25S for leaves (refer to FIG. 11) including the silver leaf image, from the submitted print data. Subsequently, the print data for leaves generating section 544 converts the extracted first print data 25G for leaves and the second print data 42*b* for combined leaves into data in a format that can be read by the leaf pressing machine 70, for example, a TIFF format (tagged image file format). The print data for leaves in the TIFF format includes information about coordinates of each pixel included in the print data for leaves and information about a pixel value of each pixel.

Note that, processing performed by the print data without leaves generating section 543 and the print data for leaves generating section 544 may be performed by the analysis processing section 542.

The stride-over determining section 545 extracts the leaf object from the first print data 25G for leaves and the second print data 25S for leaves that are generated by the print data for leaves generating section 544. Then, the stride-over determining section 545 determines whether or not there is a leaf object striding over a boundary between a gold leaf region 11*g* (first region) where leaf pressing processing is performed with the gold leaf roll 10*g* and a silver leaf region 11*s* (second region) where the leaf pressing processing is performed with the silver leaf roll 10*s*. Then, when there is no leaf object striding over the boundary (OK), the stride-over determining section 545 informs the print data for combined leaves generating section 546 of OK. When there is a leaf object striding over the boundary (NG), the stride-over determining section 545 informs the image adjusting section 547 of NG.

When the stride-over determining section 545 determines that there is no leaf object striding over the boundary, the print data for combined leaves generating section 546 performs processing for generating print data for combined leaves. The print data for combined leaves generating section 546 includes a dividing/replacing section 546*a* and an image rotating section 546*b*.

The dividing/replacing section 546*a* divides each of the gold image in the first print data 25G for leaves and the silver image in the second print data 25S for leaves. Subsequently, the dividing/replacing section 546*a* replaces one of the divided leaf images with one of other divided leaf images that hold the boundary between the gold leaf image and the silver leaf image to generate a first combined-leaves image and a second combined-leaves image. The image rotating section 546*b* rotates the second combined-leaves image generated by the dividing/replacing section 546*a* at a predetermined angle.

As described above, the print data for combined leaves generating section 546 generates the first print data 42*a* for combined leaves including the first combined-leaves image and the second print data 42*b* for combined leaves including the second combined-leaves image after being rotated. The print data for combined leaves generating section 546 supplies the generated first print data 42*a* for combined leaves and the generated second print data 42*b* for combined leaves to the output processing section 549.

When the stride-over determining section 545 determines that there is the leaf object striding over the boundary, the image adjusting section 547 performs image processing for changing positions of the first print data 25G for leaves (gold leaf image) and the second print data 25S for leaves (silver leaf image) so that the leaf object striding over the boundary no more strides over the boundary. The image adjusting section 547 includes an image shift section 547*a* and an image rotating section 547*b*.

The image shift section 547*a* performs image processing for moving (entire image including) the gold leaf image and the silver leaf image in a vertical direction with respect to the boundary. Note that the image shift section 547*a* may perform the image processing for moving the image in the submitted data before the leaf image is extracted.

The image rotating section 547*b* performs the image processing for rotating (entire image including) the gold leaf image and the silver leaf image. After the gold leaf image and the silver leaf image are moved in the vertical direction with respect to the boundary by the image shift section 547*a* and the image rotating section 547*b*, continuously the image processing for rotating the gold leaf image and the silver leaf image may be performed. Note that the image rotating section 547*b* may perform the image processing for moving the image in the submitted data before the leaf image is extracted.

According to the present embodiment, the image adjusting section 547 changes the position of the image in the print data in the submitted data holding section 541 before the print data for leaves generating section 544 generates the print data for leaves in each color, and then returns the image whose position has been changed to the submitted data holding section 541. However, the present invention is not limited to the embodiment. The position of the leaf image in the print data for leaves in each color output from the print data for leaves generating section 544 may be individually changed.

At this point, when the leaf object striding over the boundary still strides over the boundary even if the image adjusting section 547 performs the image adjustment, the print data for leaves generating section 544 supplies the first print data 25G for leaves and the second print data 25S for leaves in the print data for combined leaves to the output processing section 549. Further, the stride-over determining section 545 notifies the attached-information-image combining section 548 and the print data for leaves generating section 544 of the problem in which the leaf object still strides over the boundary even after the image has been adjusted (NG).

The attached-information-image combining section 548 applies a positioning image (match mark image M), (refer to FIG. 14 described below), as attached information when the leaf pressing processing is performed by the leaf pressing machine 70, in a region corresponding to a cutting region 26*t* or 26*u* at a leading end side of the a sheet in a sheet feeding direction in the printing data without leaf. The cutting region 26*t* and 26*u* have a width having a predetermined distance from an end portion of the sheet in the sheet feeding direction, and are cut after the image is formed on the sheet. At this point, a positioning image is applied at a position (i.e., cutting region) corresponding to a sheet feeding direction when each leaf pressing processing is performed with the first print data 42*a* for combined leaves and the second print data 42*b* for combined leaves.

Further, the attached-information-image combining section 548 applies information indicating the sheet feeding direction and a sheet feeding order of the sheet to correspond to an order of each leaf pressing processing of the first print data 42*a* for combined leaves and the second print data 42*b* for combined leaves in a region corresponding to the cutting region at the leading end side of the sheet in the sheet feeding direction in the print data without leaves.

The output processing section 549 outputs the print data supplied from the analysis processing section 542, the print data without leaves obtained by combining the attached information images by the attached-information-image combining section 548, the print data for combined leaves generated by the print data for combined leaves generating section 546, or the print data for leaves generated by the print data for leaves generating section 544. The output processing section 549 supplies the data described above to the RIP processing section 55.

[Process of Submitted Data Processing Method]

Subsequently, the submitted data processing method according to the first embodiment will be described.

Figure 4:
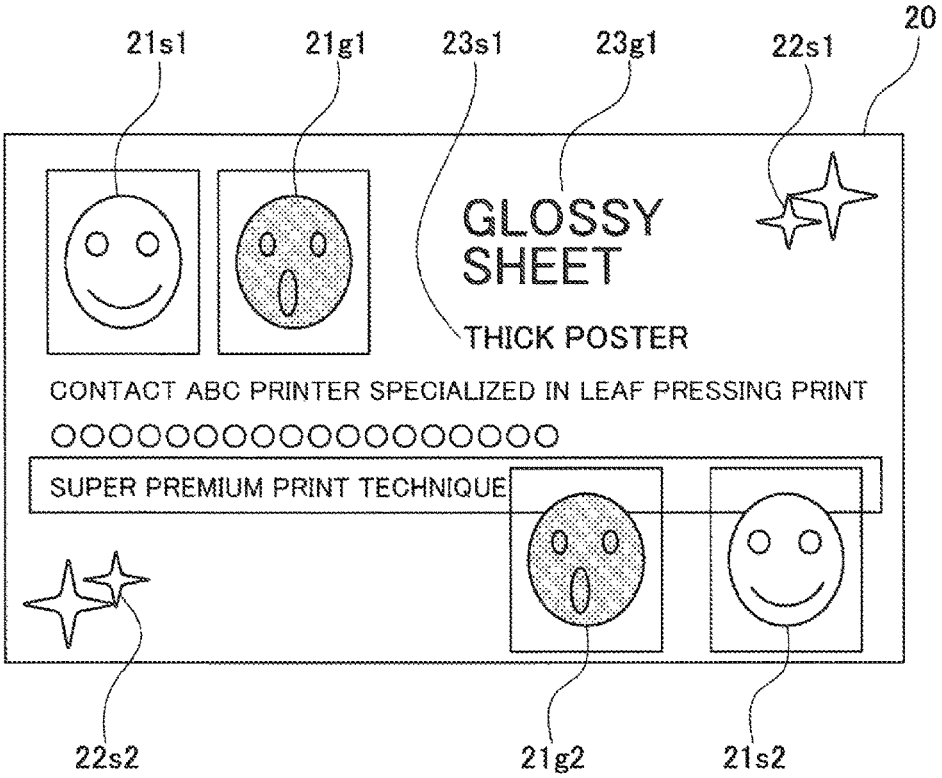
FIG. 4 illustrates submitted data dotted with a plurality of different leaf objects.
Figure 8:
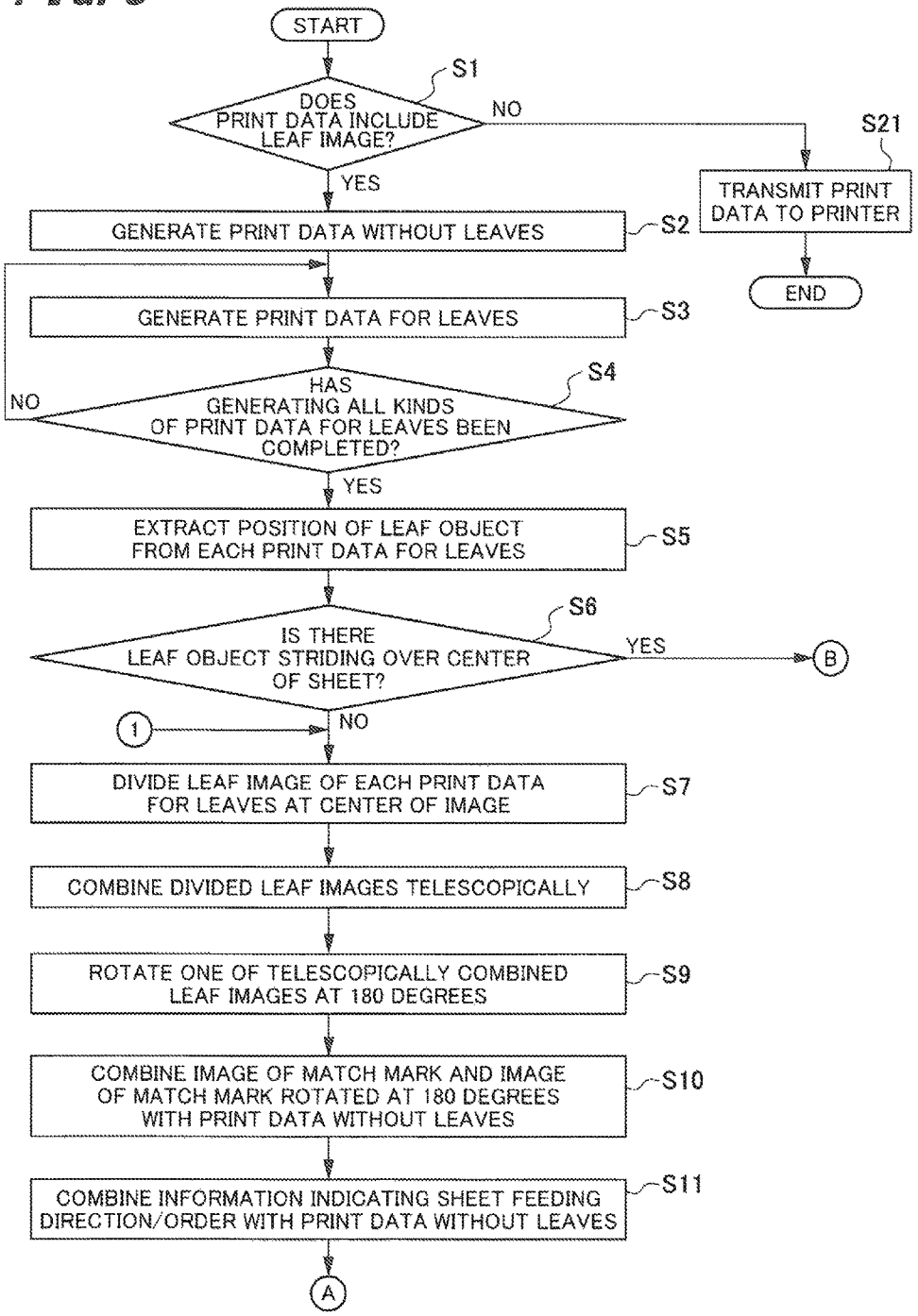
FIG. 8 is a flowchart illustrating a process (1) of a submitted data processing method according to the first embodiment of the present invention.
Figure 9:
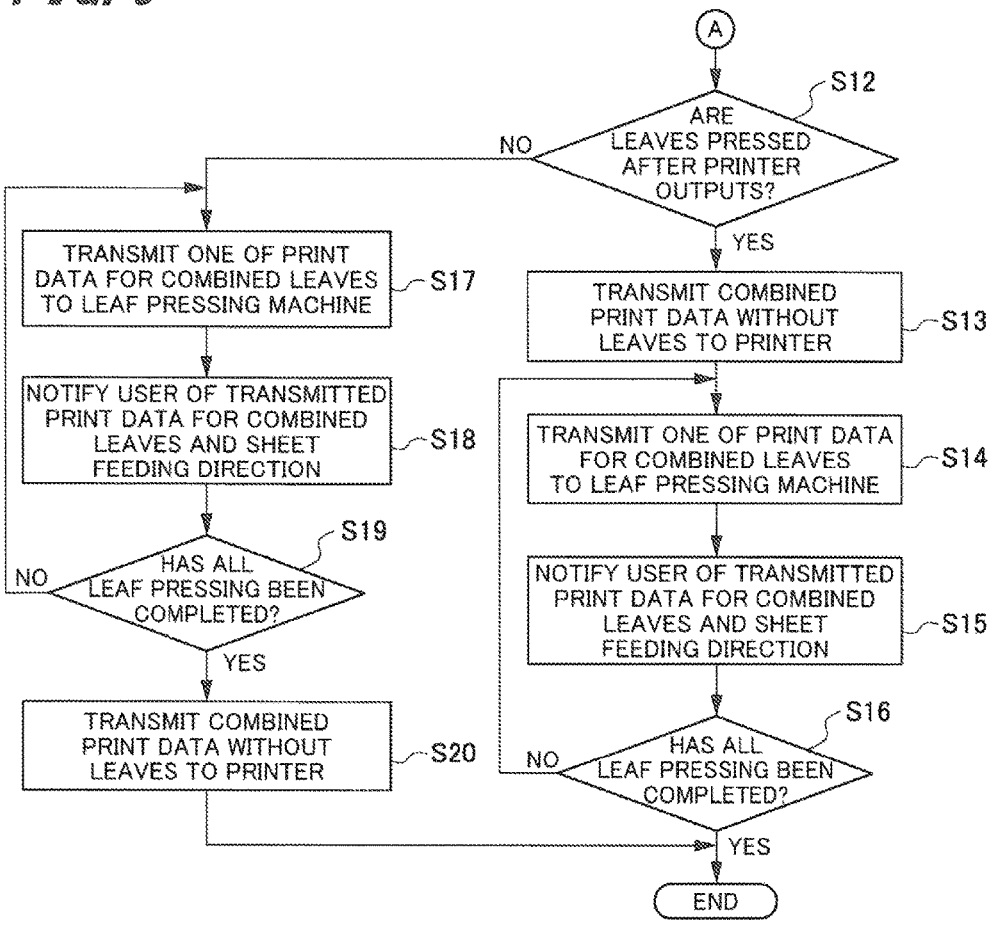
FIG. 9 is a flowchart illustrating a process (2) of the submitted data processing method according to the first embodiment of the present invention.
Figure 10:
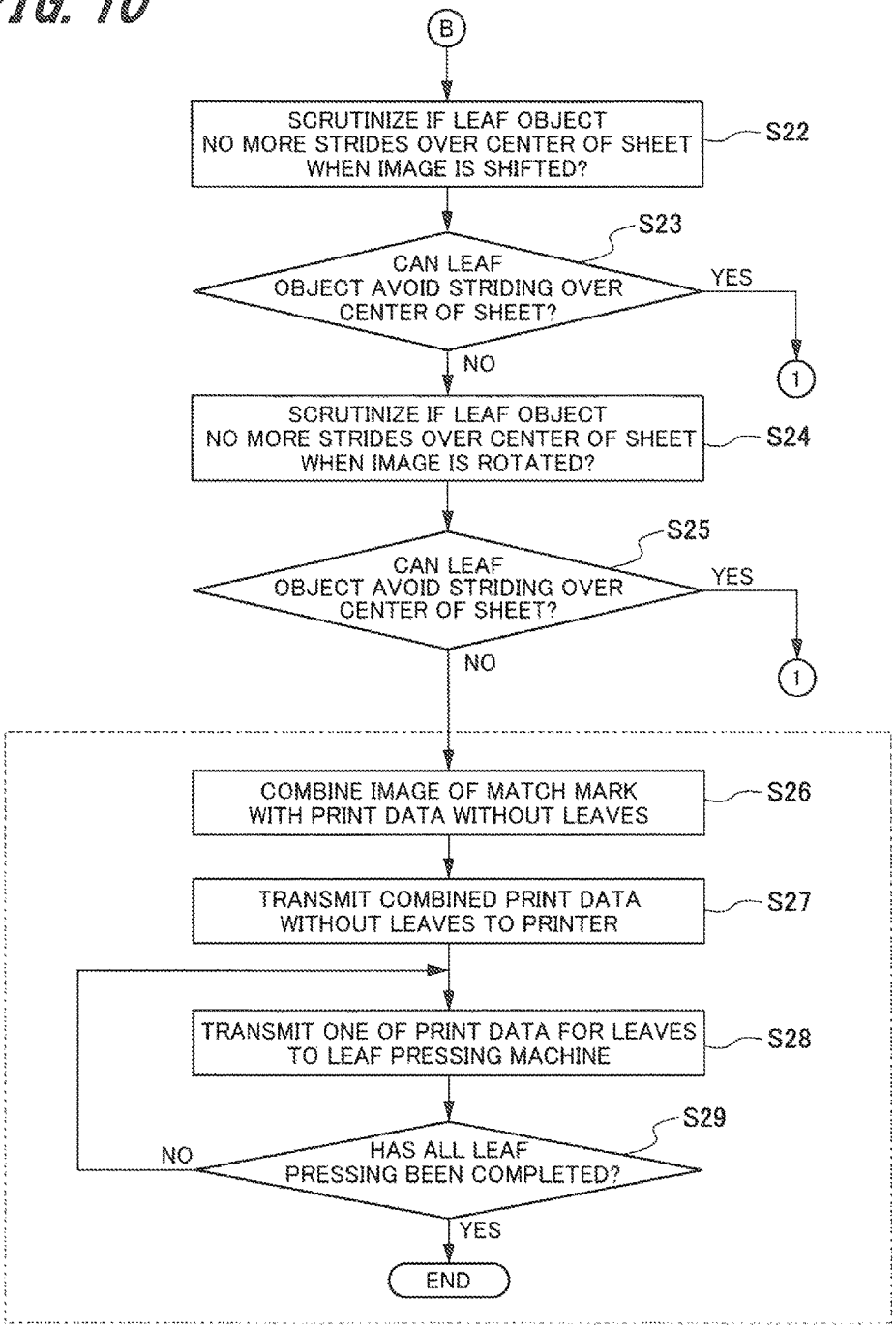
FIG. 10 is a flowchart illustrating a process (3) of the submitted data processing method according to the first embodiment of the present invention.

FIG. 8 is a flowchart illustrating a process (1) of a submitted data processing method. FIG. 9 is a flowchart illustrating a process (2) of a submitted data processing method. Further, FIG. 10 is a flowchart illustrating a process (3) of a submitted data processing method. With reference to FIGS. 11 to 17, the flowcharts illustrated in FIGS. 8 to 10 will be described. As a condition, submitted data 20 illustrated in FIG. 4 is to include the gold and silver leaf images, and further, the boundary is to correspond to a center line that divides the sheet into two in a width direction that is vertical with respect to the sheet forwarding direction.

First, when the print job is input into the controller 50 from the client terminal 1 via the communication I/F 56, the input processing section 540 temporarily holds the print job in the submitted data holding section 541. Note that, although an example of the print data submitted to the print job is described, the print data not included in the print job may be applied.

Next, the analysis processing section 542 determines whether or not there is a leaf image in the print data, included in the print job (S1). Methods of checking if there is the leaf image in the print data includes a method of referring to the print setting information and scanning the print data for each pixel.

When, in step S1, there is no leaf image in the print data included in the print job (NO in S1), the analysis processing section 542 outputs the print data to the printer 60 as it is (S21). When the step S21 is completed, the submitted data processing is ended.

Next, when, in step S1, the analysis processing section 542 determines that there is a leaf image in the submitted print data (YES in S1), the print data without leaves generating section 543 receives the determination result and the print data from the analysis processing section 542 to generate the print data without leaves from the submitted print data (S2).

Next, the print data for leaves generating section 544 generates the first print data for leaves including the gold leaf image and the second print data for leaves including the silver leaf image from the submitted print data (S3).

Figure 11:
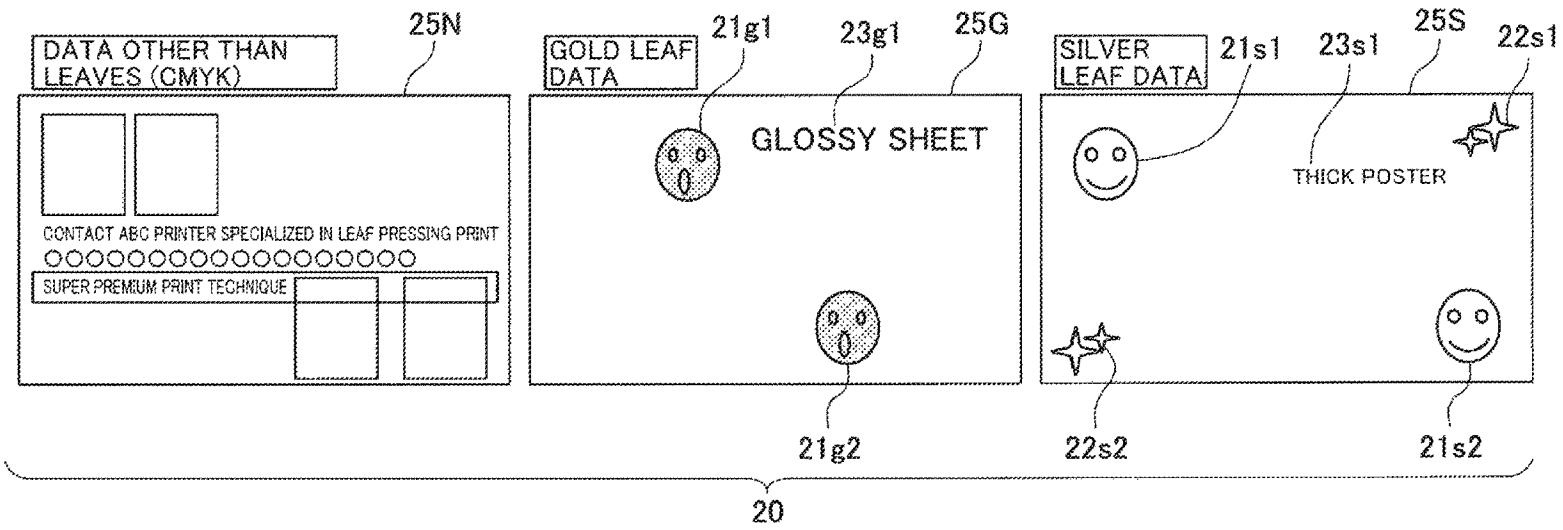
FIG. 11 illustrates print data without a leaf image, print data for leaves in a first color, and print data for leaves in a second color generated from the submitted data.

FIG. 11 illustrates an example of the print data without leaves, the first print data for leaves, and the second print data for leaves that are generated from the submitted data 20. By the processing in step S2, print data 25N without leaves excluding the gold leaf and silver leaf objects is generated. Further, by the processing in step S3, the first print data 25G for leaves including only the gold objects (21*g*1, 21*g*2, 23*g*1) are generated. The second print data 25S for leaves including only silver objects (21*s*1, 21*s*2, 22*s*1, 22*s*2, 23*s*1) are generated.

The explanation returns to FIG. 8. After the processing in step S3, the print data for leaves generating section 544 determines whether or not generating the print data for leaves including all kinds of leaf images has been completed (S4). When there is the print data for leaves including the leaf image to be generated (NO in S4), the print data for leaves generating section 544 returns to step S3 to generate the print data for leaves including the corresponding leaf image.

When, in step S4, the print data for leaves generating section 544 determines that generating the print data for leaves including all kinds of leaf images (in this example, gold leaf image and silver leaf image) has been completed (YES in S4), the stride-over determining section 545 extracts a position of the leaf object from each print data for leaves (S5).

Figure 12:
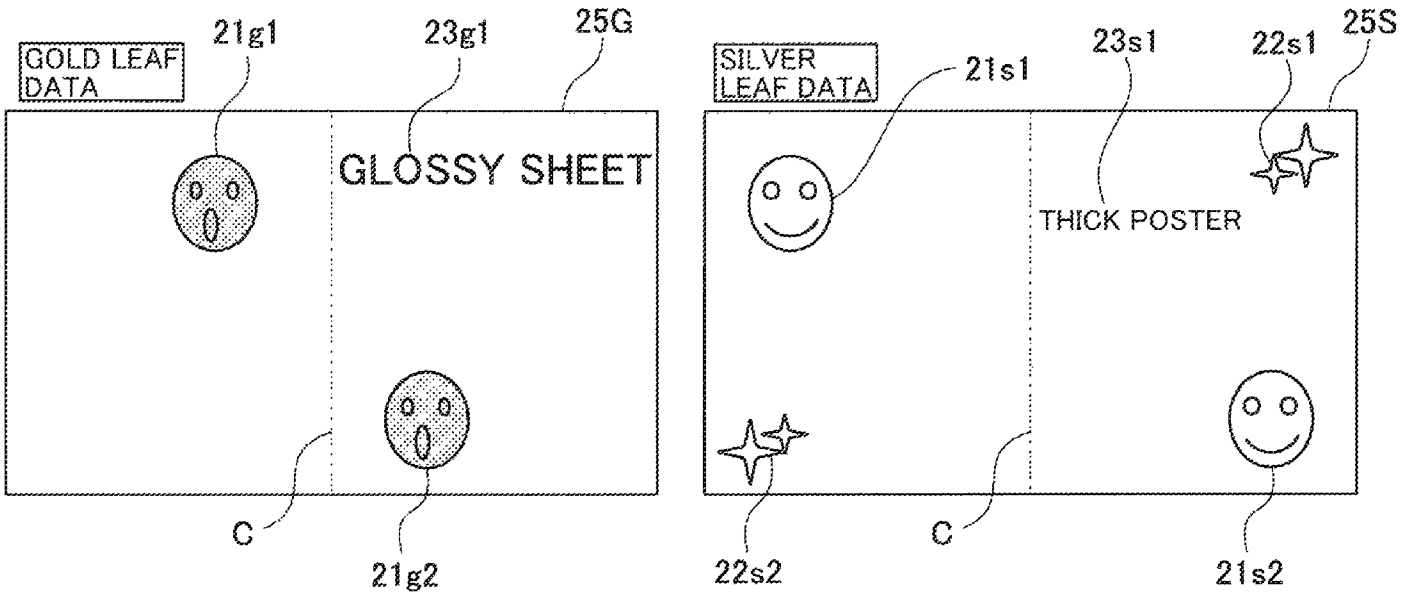
FIG. 12 illustrates a method of determining whether there is a leaf object striding over the boundary, according to the first embodiment of the present invention.

Next, as illustrated in FIG. 12, the stride-over determining section 545 determines whether or not there is a leaf object striding over a center of a sheet (boundary C) in the extracted leaf object (S6).

FIG. 12 illustrates a method of determining whether there is a leaf object striding over the boundary, according to the first embodiment.

In the first print data 25G for leaves, any of the gold leaf objects (21*g*1, 21*g*2, 23*g*1) does not stride over the boundary C. In a similar manner, in the second print data 25S for leaves, none of the silver leaf objects (21*s*1, 21*s*2, 22*s*1, 22*s*2, 23*s*1) strides over the boundary C.

(Case when there is Leaf Object Striding Over Boundary)

The explanation returns to FIG. 8. Next, when there is no leaf object striding over the center of the sheet (boundary C) in the leaf image in the print data for leaves (NO in S6), the stride-over determining section 545 proceeds to processing in step S7. On the other hand, when there is a leaf object striding over the center of the sheet, the image shit or/and image rotation is performed not to stride over the center of the sheet as described below. The image shift or/and image rotation will be described below.

Then, the dividing/replacing section 546*a* of the print data for combined leaves generating section 546 divides each of the gold leaf image in the first print data 25G for leaves and the silver leaf image in the second print data 25S for leaves at the center of the sheet (boundary C) (S7).

Then, the dividing/replacing section 546*a* telescopically combines one of the divided leaf image with one of other divided leaf images that hold the boundary C between the gold leaf image (first print data 25G for leaves) and the silver leaf image (second print data 25S for leaves) to generate two kinds of combined leaf images (print data for combined leaves) (S8).

Then, the image rotating section 546*b* in the print data for combined leaves generating section 546 rotates one of the combined leaf images telescopically combined by the dividing/replacing section 546*a* at a predetermined angle (180 degrees in this example) (S9).

FIG. 13 illustrates a method of creating the first print data 25G for leaves and the second print data 25S for leaves according to the first embodiment.

A divided leaf image 25*g*L on the left side of the gold leaf image and a divided leaf image 25*s*R on the right side of the silver leaf image are combined with each other to generate the first combined-leaves image (first print data 42*a* for combined leaves). In a similar manner, the divided leaf image 25*g*R on the right side of the gold leaf image and the divided leaf image 25*s*L on the left side of the silver leaf image are combined with each other to generate the second combined-leaves image (second print data 42*b* for combined leaves). Subsequently, the image rotating section 546*b* rotates the second combined-leaves image (second print data 42*b* for combined leaves) at 180 degrees. The processing is performed to rotate the second combined-leaves at 180 degrees to be combined with each other, so that the gold leaf image is imposed on the left side and the silver leaf image is imposed on the right side. With this arrangement, generating the print data for combined leaves including the gold leaf object and the silver leaf object is completed.

The explanation returns to FIG. 8. Then, the attached-information-image combining section 548 applies positioning image (match mark image M) (refer to FIG. 14 described below) as the attached information (S10), when the leaf pressing processing is performed by the leaf pressing machine 70 in a region corresponding to the cutting region 26*t* or 26*u* at the leading end side of the sheet in the sheet feeding direction in the print data without leaves. The match mark image M is not limited to a two-dimensional bar code, but may be an arbitrary image such as a cross.

Then, the attached-information-image combining section 548 applies information indicating the sheet feeding direction and the sheet feeding order to correspond to the order of each leaf pressing processing of the first print data 42*a* for combined leaves and the second print data 42*b* for combined leaves in the region corresponding to the cutting region 26*t* or 26*u* at the leading end side of the sheet in the sheet feeding direction in the print data without leaves (S11).

Figure 14:
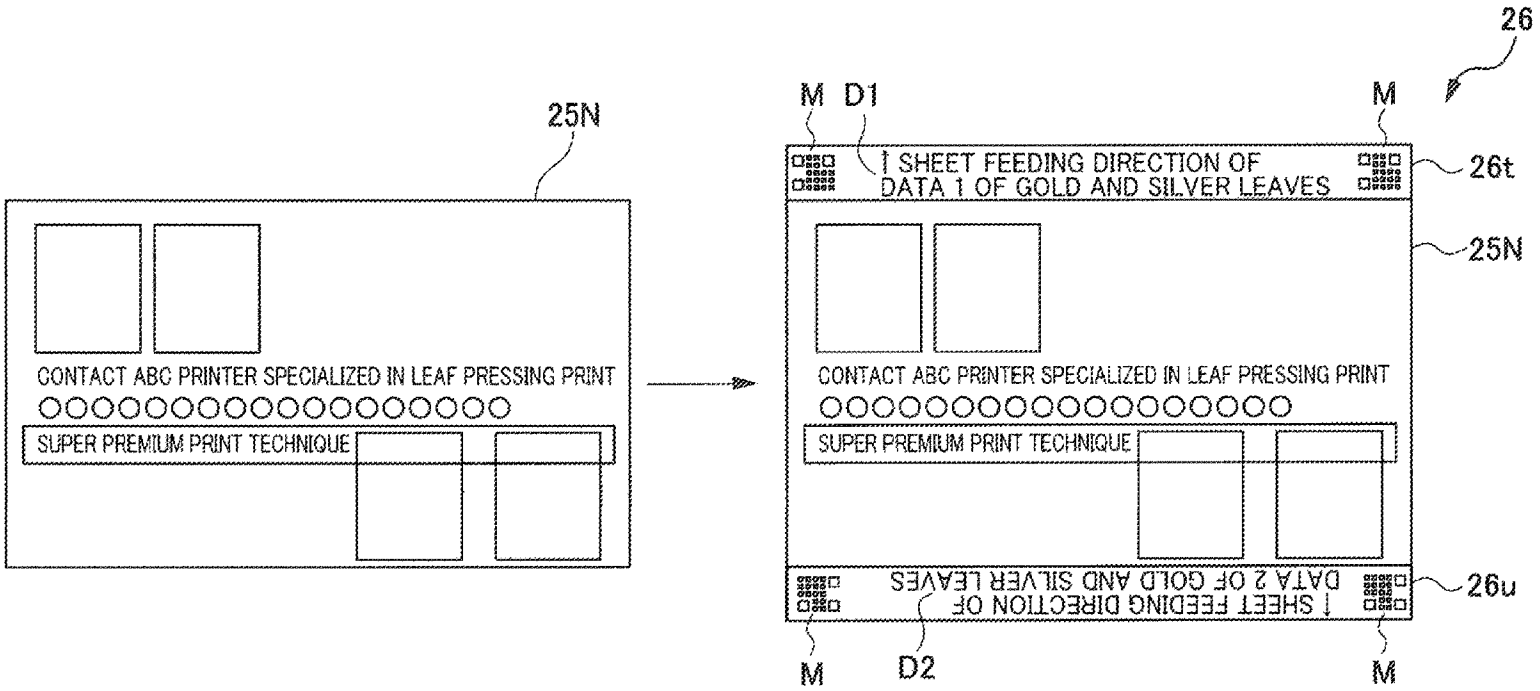
FIG. 14 illustrates processing for applying attached information to a cutting region of the print data without leaves, according to the first embodiment of the present invention.

FIG. 14 illustrates processing for applying the attached information to the cutting region of the print data 25N without leaves according to the first embodiment.

The match mark image M is a positioning mark or the like (figure, symbol, two-dimensional bar code or the like), to be printed in margin such as the cutting region 26*t*, 26*u* of the sheet, so that the leaf image and the leaf pressing position are not misaligned, and is printed at a leading end in the sheet feeding direction. According to the present embodiment, after the leaf is once pressed, in order to rotate the sheet at 180 degrees without replacing the leaf rolls and press the leaves again, the match mark image M rotated at 180 degrees, information D2 indicating the sheet feeding direction/sheet feeding order, and "the sheet feeding direction of the gold and silver leaves data 2 " are applied in the cutting region 26*u* of the image in the print data 25N without leaves.

Next, the output processing section 549 outputs the combined print data 26 without leaves, in which the match mark image M and the image of the information indicating the sheet feeding direction/sheet feeding order are combined with each other. The controller 50 transmits the combined print data 26 without leaves (FIG. 14) to the printer 60. Print processing by the printer 60 and leaf pressing print by the leaf pressing machine 70 will be described below.

The explanation returns to FIG. 8. After the processing in step S11 illustrated in FIG. 8 is ended, the CPU 51 of the controller 50 determines whether or not, after the printer 60 performs the print processing, the leaf pressing machine 70 is set to perform the leaf pressing processing (S12 in FIG. 9).

When it is determined that the leaf pressing machine 70 is set to perform the leaf pressing processing after the printer 60 performs the print processing in step S12 (YES in S12), the CPU 51 transmits the combined print data 26 without leaves to the printer 60 (S13).

Then, the CPU 51 transmits one of the combined print data for leaves (e.g., first print data 42*a* for combined leaves) to the leaf pressing machine 70 (S14). At this point, the CPU 51 displays the leaf image of the transmitted first print data 42*a* for combined leaves and the sheet feeding direction on a screen of the operation display unit 74, and notifies the user of them (S15).

Then, the CPU 51 determines whether or not the leaf pressing has been completed on all leaf images (print data for combined leaves) (S16). When the leaf pressing has not been completed on some leaf images (NO in S16), the processing returns to step S14 to transmit the next print data for combined leaves (e.g., second print data 42*b* for combined leaves) to the leaf pressing machine 70.

When, in step S16, it is determined that the leaf pressing has been completed on the all leaf images (first and second print data for combined leaves) (YES in S16), the CPU 51 ends the submitted data processing.

On the other hand, when the leaf pressing machine 70 performs the leaf pressing processing first in step S12 (NO in S12), the CPU 51 transmits the first print data 42*a* for combined leaves to the leaf pressing machine 70 (S17). Then, the CPU 51 performs the processing in steps S18 and S19. The processing in steps S18 and S19 is the same as that in steps S15 and S16.

Then, when it is determined that the leaf pressing has been completed on the all leaf images (first and second print data for combined leaves) in step S19 (YES in S19), the CPU 51 transmits the combined print data 26 without leaves to the printer 60 (S20). When the processing in step S20 is ended, the CPU 51 ends the submitted data processing.

Figure 15:
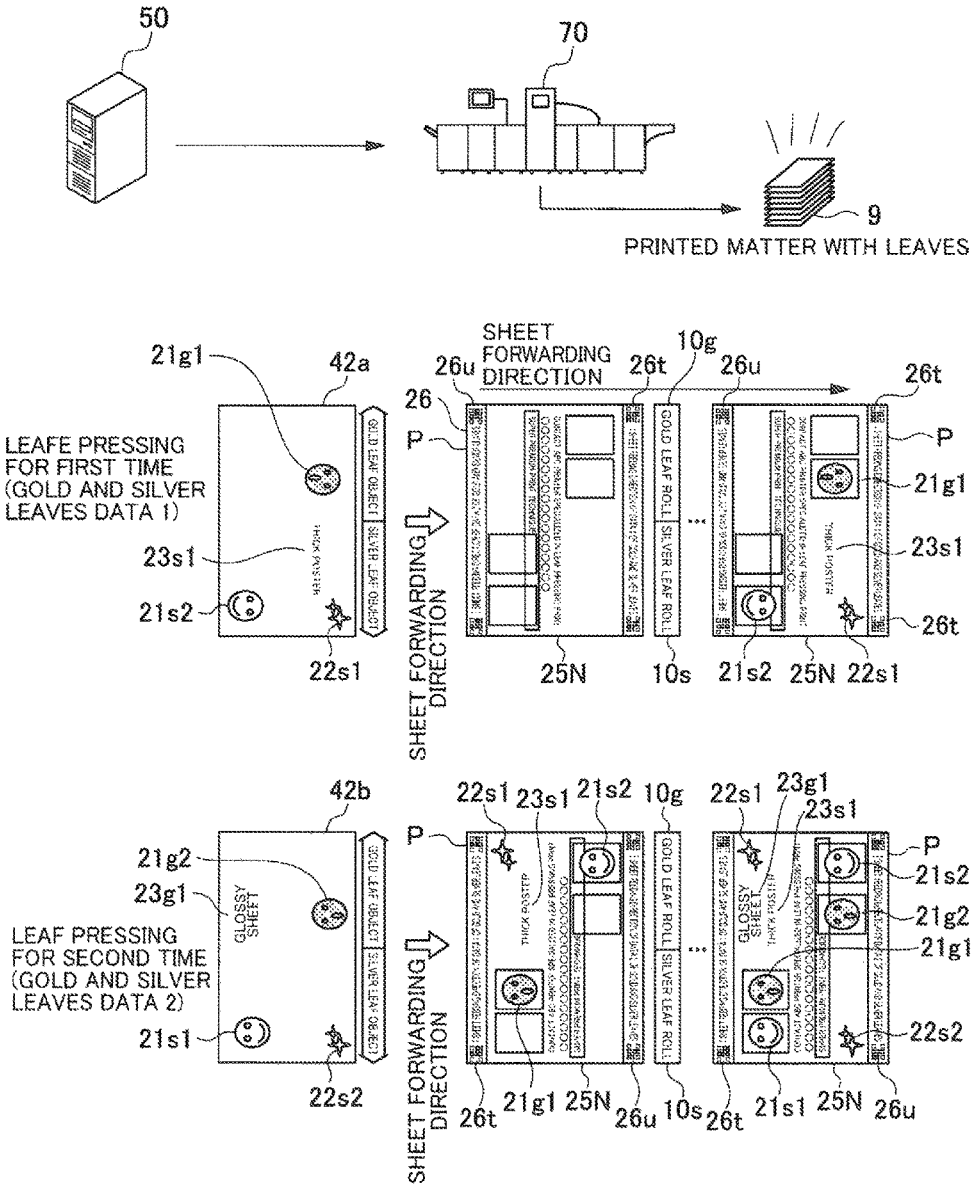
FIG. 15 illustrates the leaf pressing processing according to the first embodiment of the present invention.

FIG. 15 illustrates the leaf pressing processing according to the first embodiment.

The first print data 42*a* for combined leaves ("data 1 of gold and silver leaves" illustrated in FIG. 15) obtained by combining the gold leaf image and the silver leaf image is first transmitted to the leaf pressing machine 70, and the leaf pressing print (leaf pressing for the first time) of the first print data 42*a* for combined leaves is notified to the user. As a notification method, it can be considered to display information on the operation display unit 74 of the leaf pressing machine 70, or display on a display device connected to the controller 50.

Then, when the leaf pressing is completed on the first print data 42*a* for combined leaves (data 1 of gold and silver leaves), the second print data 42*b* for combined leaves (data 2 of gold and silver leaves) is transmitted to the leaf pressing machine 70, and it is notified to the user to rotate the sheet at 180 degrees to set it (leaf pressing for the second time). With this arrangement, the printed matter with leaves 44 formed with all gold leaf image and silver leaf image can be obtained without any mistake in the order and the sheet feeding direction of leaf pressing in the leaf pressing for both the first time and the second time.

Note that notification of the leaf pressing print (rotation of the sheet at 180 degrees) of the first print data 42*a* for combined leaves or the second print data 42*b* for combined leaves described above is not essential. However, if the user is notified, mistakes drastically decreased in the number of times of leaf pressing by the leaf pressing machine 70 and the direction of the sheet can be expected.

By the above-described submitted data processing according to the first embodiment, in the leaf pressing machine mounting the plurality of leaf rolls, even when two or more kinds of leaf objects are dotted all over the image in the submitted data, two or more kinds of the leaf pressing print can be performed without replacing the leaf rolls.

(Case when there is Leaf Object Striding Over Boundary)

Next, the explanation returns to FIG. 8, and processing will be described when there is a leaf object striding over the center (boundary C) of the sheet included in the print data for leaves.

In step S6, when there is a leaf object striding over the center (boundary C) of the sheet in the leaf image in the print data for leaves (YES in S6), the stride-over determining section 545 proceeds to processing in step S22 illustrated in FIG. 10.

Then, the stride-over determining section 545 performs image processing for moving (entire image including) the gold leaf image and the silver leaf image in the vertical direction with respect to the center (boundary C) of the sheet by the image adjusting section 547 to scrutinize whether the leaf object no more strides over the center (boundary C) of the sheet (S22).

Figure 16:
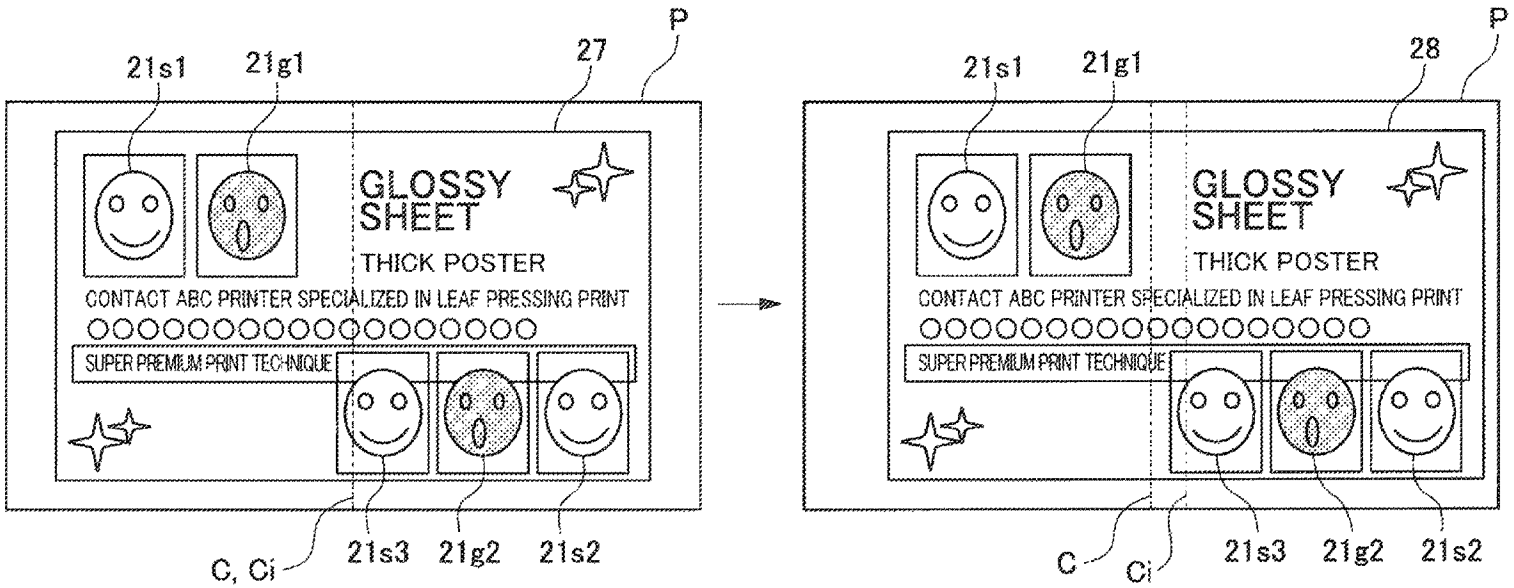
FIG. 16 illustrates image adjusting processing (image shift) according to the first embodiment of the present invention.

FIG. 16 illustrates image adjusting processing (image shift) according to the first embodiment. In the image 27 located on the left side in FIG. 16, a silver leaf object 21*s*3 is located over the boundary C, and a center line Ci and the boundary C of the image 27 correspond to each other. In a moved image 28 on the right side, the silver leaf object 21*s*3 avoids striding over the boundary C, and the center line Ci and the boundary C of the image 28 do not correspond to each other. When there is a leaf object striding over the center (boundary C) of the sheet, the image is shifted up to a position where there is no more leaf object striding over the center of the sheet. A direction of shift is determined by comparing a right region and a left region from the boundary, and the image is to be shifted in a direction having smaller shift.

The explanation returns to FIG. 8. The stride-over determining section 545 determines whether or not the leaf object can avoid striding over the center of the sheet by the image shift (S23). Here, when the leaf object can avoid striding over the center of the sheet (YES in S23), the processing proceeds to step S7, and dividing and telescopically combining are performed on each leaf image in each print data for leaves after the image is adjusted. On the other hand, when the leaf object cannot avoid striding over the center of the sheet (NO in S23), the processing proceeds to step S24.

Then, the stride-over determining section 545 performs the image processing for rotating (entire image including) the gold leaf image and the silver leaf image by the image adjusting section 547 to scrutinize whether the leaf object no more strides over the center (boundary C) of the sheet (S24).

Figure 17:
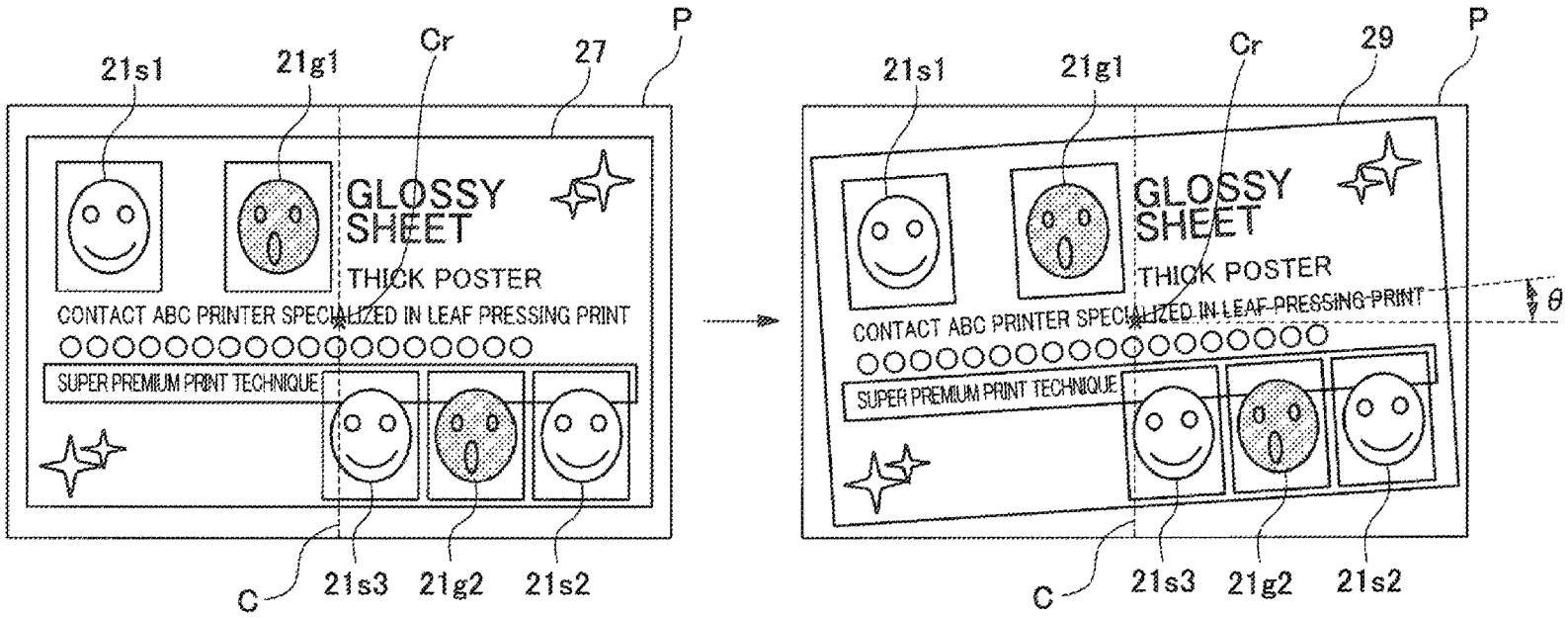
FIG. 17 illustrates image adjusting processing (image rotation) according to the first embodiment of the present invention.

FIG. 17 illustrates the image adjusting processing (image rotation) according to the first embodiment.

In a similar manner to FIG. 16, in the image 27 located on the left side in FIG. 17, the silver leaf object 21*s*3 is located over the boundary C. When there is such a leaf object striding over the center of the sheet, the image is rotated up to a position where there is no more leaf object striding over the center of the image 29. In this example, although the image is rotated at the angle of θ degrees around a center point Cr of the image, the rotation center may be arbitrary.

Here, if the image is positioned obliquely, the sheet needs to have larger size than that of an original document, and thus the image is rotated at an angle for minimizing the size of the imposition sheet. The method also includes a method of combining the image shift and the image rotation described above to rotate the sheet at the angle for minimizing the size of the sheet. Note that, in consideration of economic efficiency of the leaf roll, the shorter the length of the sheet in the sheet forwarding direction is, the better the leaf roll is.

The explanation returns to FIG. 8. The stride-over determining section 545 determines whether or not the leaf object can avoid striding over the center of the sheet by the image rotation (S25). Here, when the leaf object can avoid striding over the center of the sheet (YES in S25), the processing proceeds to step S7 to perform dividing, telescopically combining and the like. On the other hand, when the leaf object cannot avoid striding over the center of the sheet (NO in S25), the CPU 51 proceeds to step S26 to perform the conventional print method (S26 to S29).

In the conventional print method, the attached-information-image combining section 548 first combines the match mark image with the print data without leaves (S26). Subsequently, the CPU 51 transmits the combined print data without leaves to the printer 60 (S27). Then, the CPU 51 transmits one of the print data without leaves (e.g., first print data 42*a* for combined leaves) to the leaf pressing machine 70 (S28).

Next, the CPU 51 determines whether or not the leaf pressing has been completed on the all leaf images (print data for combined leaves) (S29). When there is some leaf images on which the leaf pressing has not been completed (NO in S29), the processing returns to step S28, and the CPU 51 transmits the next print data for combined leaves (e.g., second print data 42*b* for combined leaves) to the leaf pressing machine 70.

When it is determined that the leaf pressing has been completed on the all leaf images (first and second print data for combined leaves) in step S29 (YES in S29), the CPU 51 ends the submitted data processing.

<2. Second Embodiment>

Next, a method of determining whether there is a leaf object striding over the boundary when the boundary is not located at the center of the sheet according to the second embodiment, will be described below.

Figure 18:
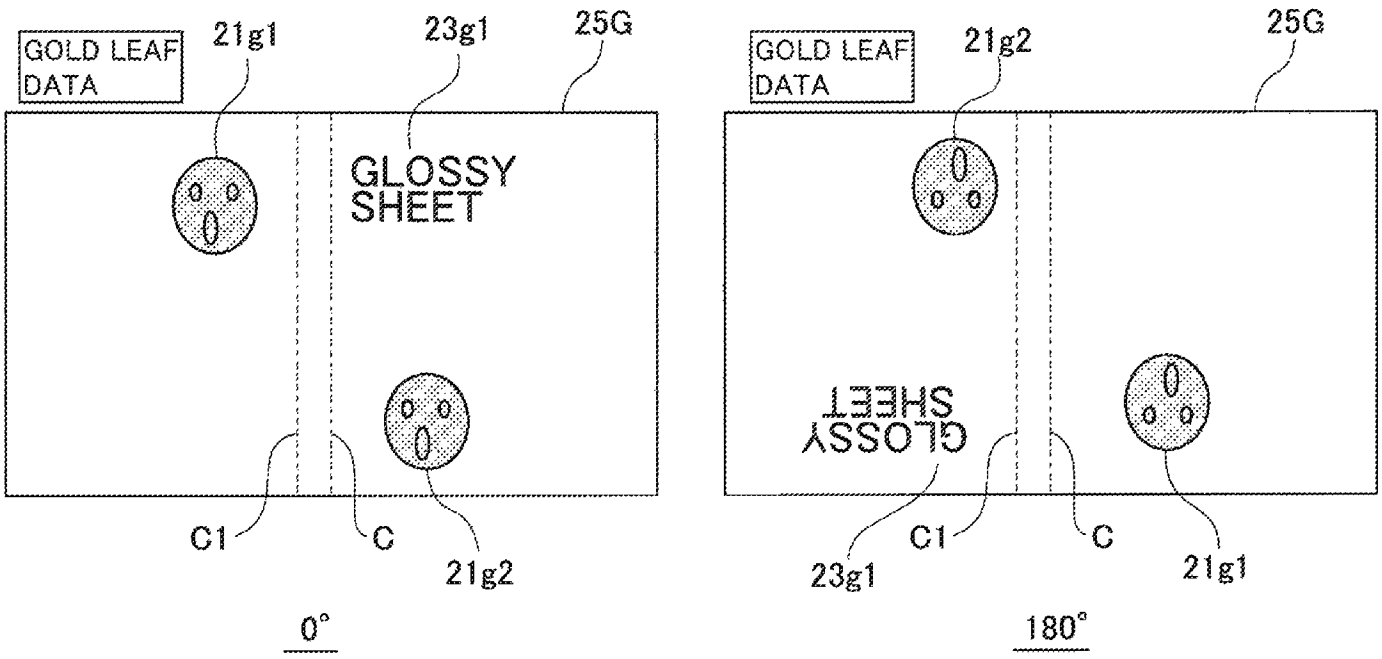
FIG. 18 illustrates a method of determining whether there is a leaf object striding over the boundary when the boundary is not located at a center of a sheet according to a second embodiment of the present invention.

FIG. 18 illustrates a method of determining whether there is a leaf object striding over the boundary when the boundary is not located at the center of the sheet according to the second embodiment.

An example of the first print data 25G for leaves including the gold leaf image will be described. In the left figure in FIG. 18, a boundary C1 of the plurality of leaf rolls is misaligned to a left side with respect to the center C of the gold leaf image rotated at 0 degrees. In the right figure in FIG. 18, each leaf object of the gold leaf image inverted at 180 degrees does not stride over the boundary C1. Therefore, it is determined that no leaf object included in the first print data 25G for leaves strides over the boundary. In a similar manner, it is also determined whether there is a leaf object striding over the boundary in the second print data 25S for leaves including the silver image.

<3. Third Embodiment>

Next, the processing of submitted data in which the page layout is set in multiple imposition according to the third embodiment, will be described.

Figure 19:
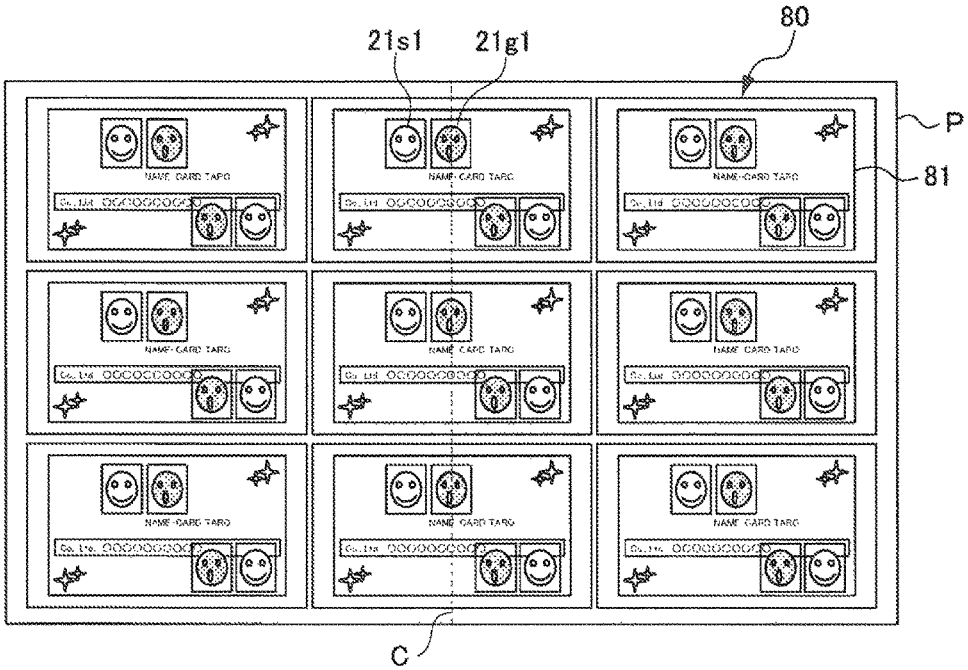
FIG. 19 illustrates an example of an image in submitted data in which page layout is set in multiple imposition.

FIG. 19 illustrates an example of an image in submitted data in which page layout is set in the multiple imposition. In print data 80 formed on a sheet P, nine images 81 are laid out in one page. The gold leaf objects 21*g*1 included in three images 81 arranged longitudinally at the center of the sheet stride over the boundary C. As described above, when there is a leaf object striding over the center of the image in the multiple imposition or ganging where print having different kinds of setting is set in one page, a position of imposition and orientation of each image are changed so that no leaf object strides over the center of the sheet.

Figure 20:
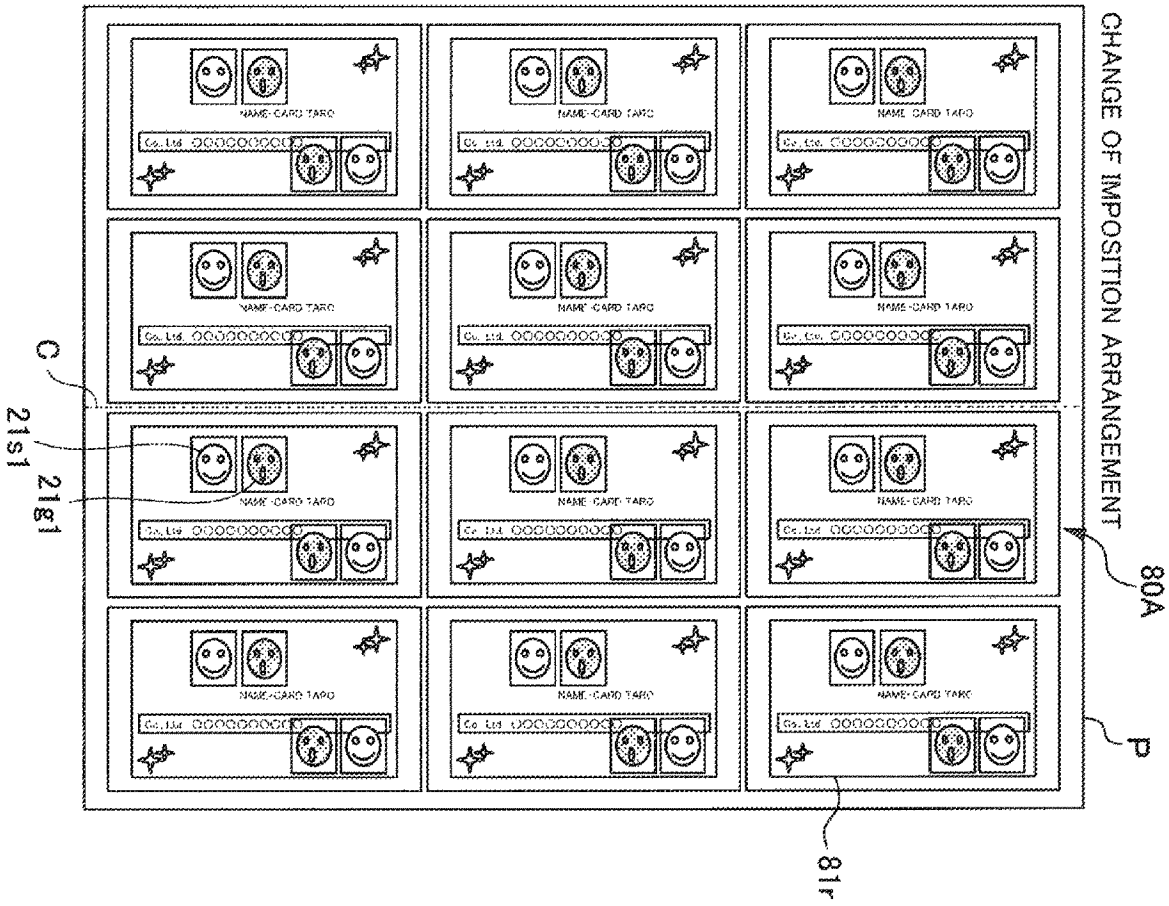
FIG. 20 illustrates a case where imposition arrangement of images is changed according to a third embodiment of the present invention.

FIG. 20 illustrates a case where imposition arrangement of the image is changed according to the third embodiment.

Print data 80A formed on the sheet P includes twelve images 81*r* (corresponding to a state where the image 81 arranged laterally in FIG. 19 is rotated at 90 degrees to be arranged longitudinally) (longitudinally 3×laterally 4) arranged in a longitudinal direction and laid out in one page. The boundary C is located between the image 81*r* in a second row and the image 81*r* in a third row, and the gold leaf object 21*g*1 avoids striding over the boundary.

Figure 21:
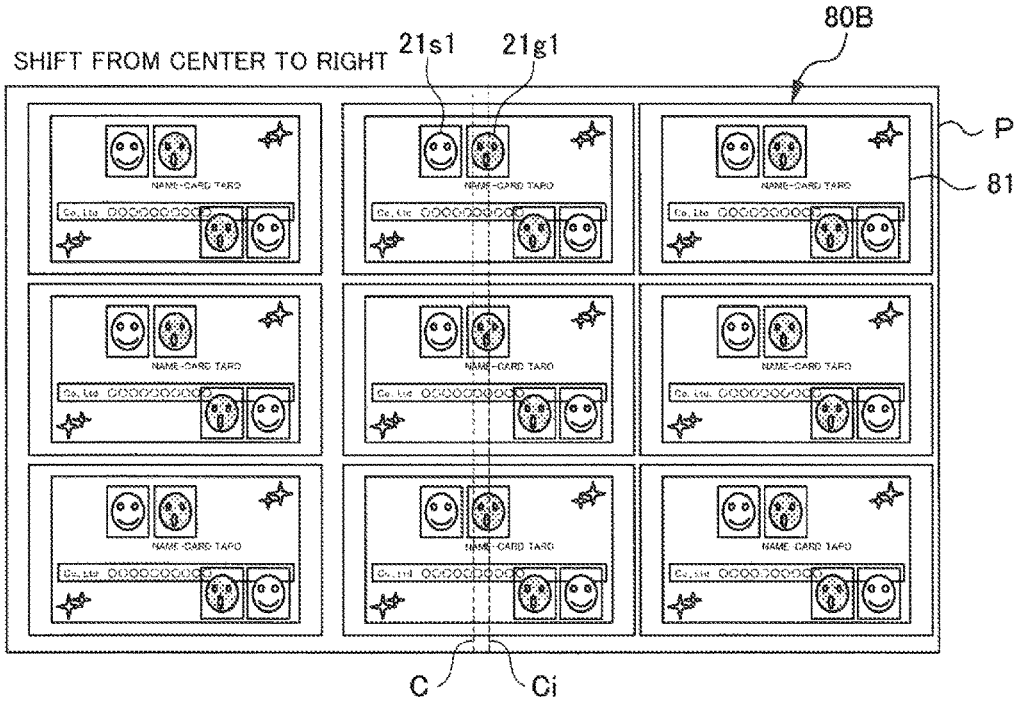
FIG. 21 illustrates a case where the image is moved in a vertical direction with respect to the boundary according to the third embodiment of the present invention.

FIG. 21 illustrates a case where the image is moved in a vertical direction with respect to the boundary according to the third embodiment. Print data 80B illustrated in FIG. 21 is obtained by shifting the images 81 arranged in a right row and a center row in the print data 80 illustrated in FIG. 19, into a right direction. With this arrangement, the boundary C is located between the gold leaf objects 21*g*1 and silver leaf objects 21*s*1, and thus the leaf objects can avoid striding over the boundary.

Figure 22:
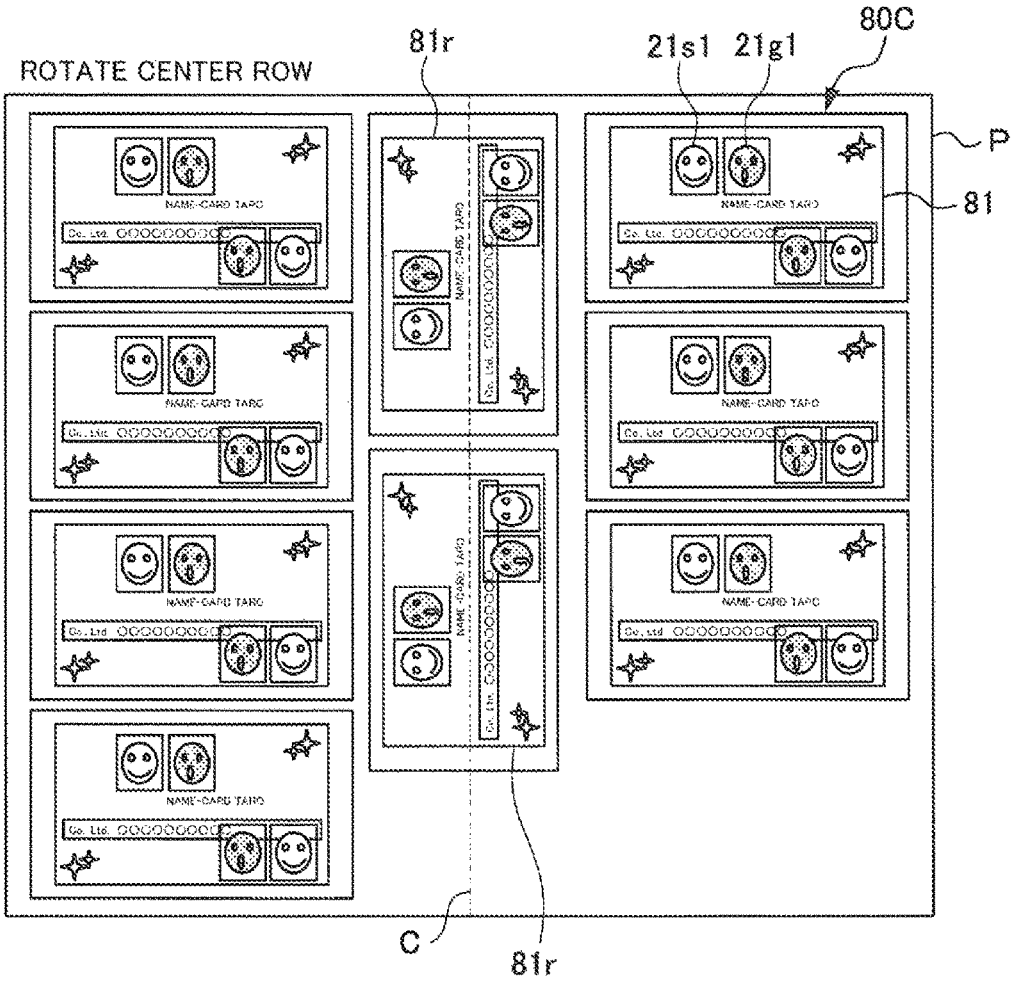
FIG. 22 illustrates a case where the image is rotated according to the third embodiment of the present invention.

FIG. 22 illustrates a case where the image is rotated according to the third embodiment. Print data 80C illustrated in FIG. 22 is obtained by rotating the images 81 arranged in the center row in the print data 80 illustrated in FIG. 19, and being set in imposition as the image 81*r*. With this arrangement, the gold leaf object 21*g*1 and the silver leaf object 21*s*1 of the image 81*r* located at the center are located at the right side to the boundary C, so that the leaf object avoids striding over the boundary.

[Process of Submitted Data Processing Method in Multiple Imposition]

Next, submitted data processing on submitted data in multiple imposition will be described.

Figure 23:
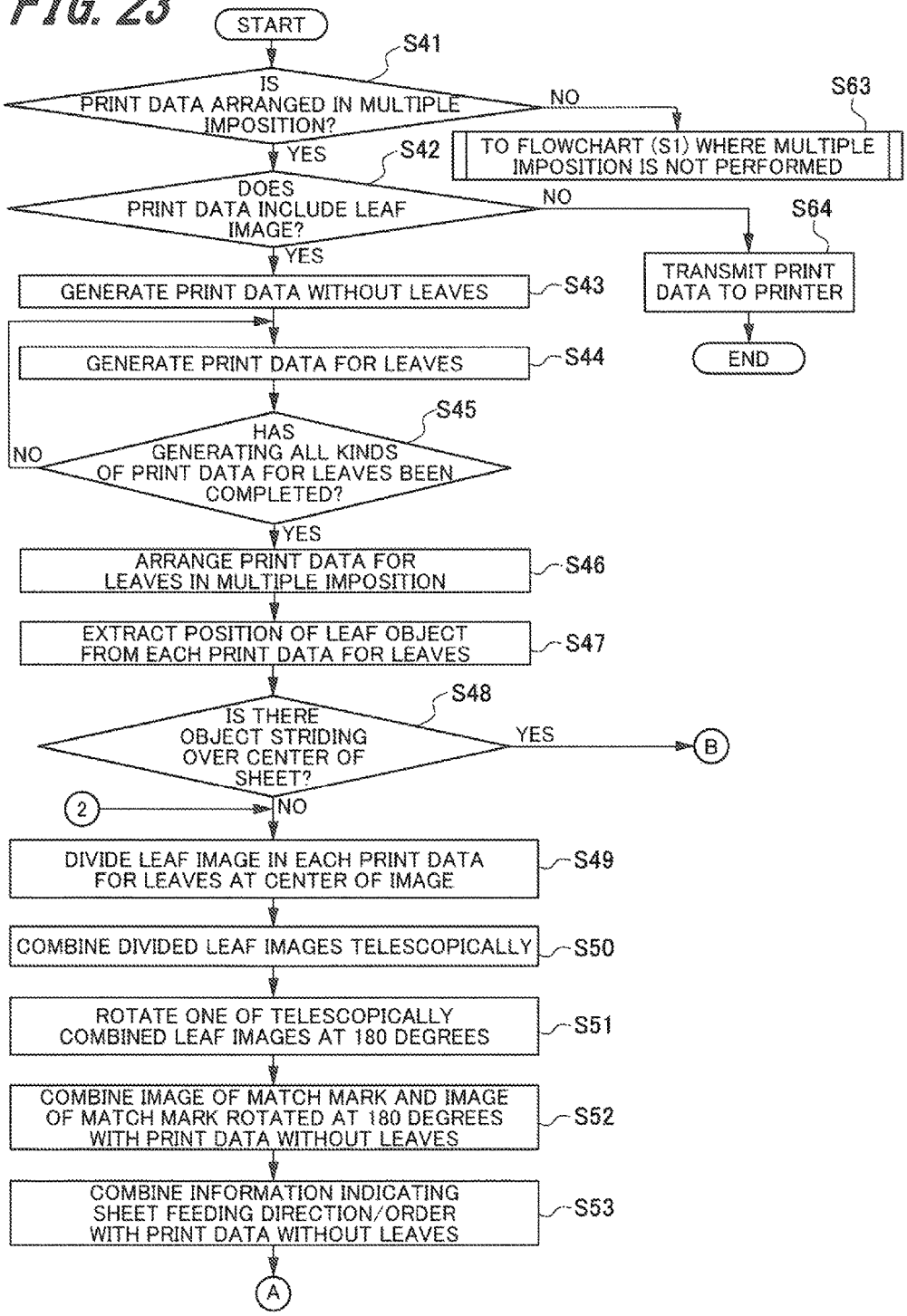
FIG. 23 is a flowchart illustrating a process (1) of a submitted data processing method according to the third embodiment of the present invention.
Figure 24:
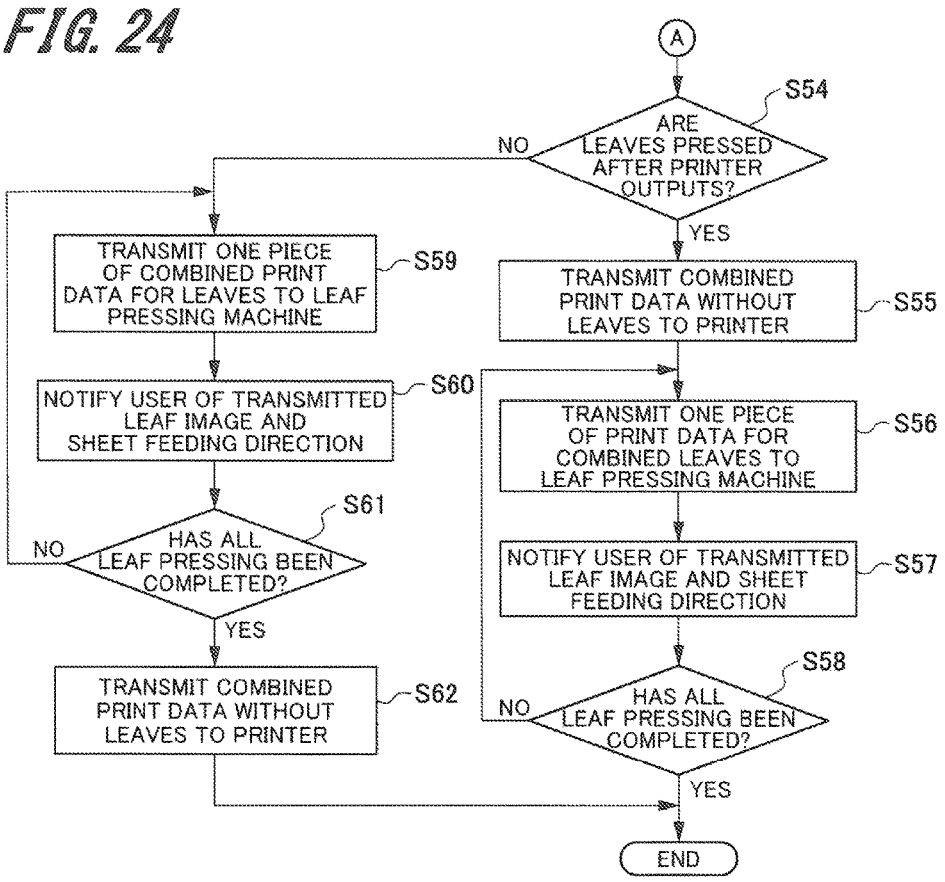
FIG. 24 is a flowchart illustrating a process (2) of the submitted data processing method according to the third embodiment of the present invention.
Figure 25:
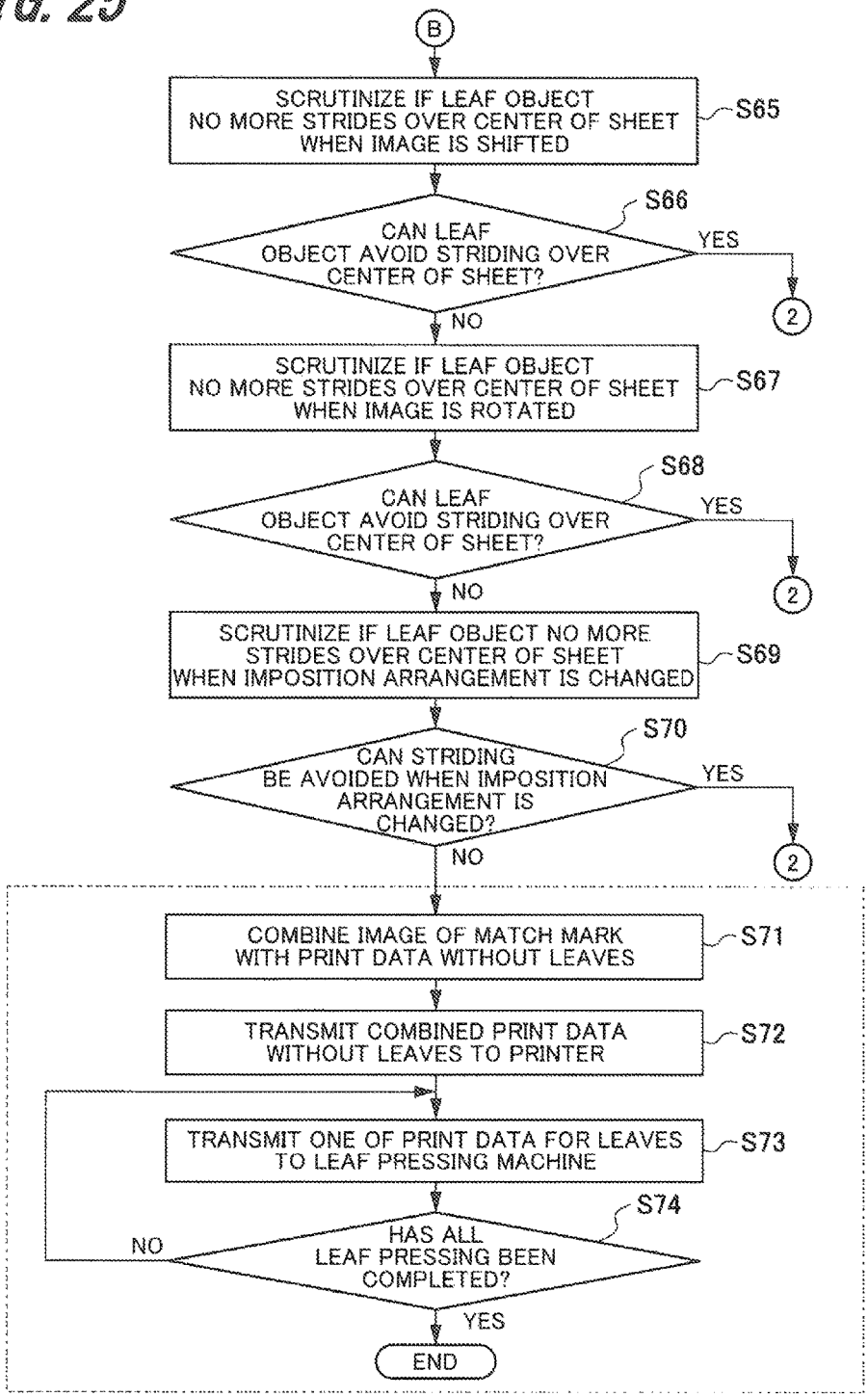
FIG. 25 is a flowchart illustrating a process (3) of the submitted data processing method according to the third embodiment of the present invention.

FIG. 23 is a flowchart illustrating a process (1) of a submitted data processing method according to the third embodiment. FIG. 24 is a flowchart illustrating a process (2) of the submitted data processing method according to the third embodiment. Further, FIG. 25 is a flowchart illustrating a process (3) of the submitted data processing method according to the third embodiment. Portions in FIGS. 23 to 25 different from those in FIGS. 8 to 10 will be mainly described. Note that, as the condition, in a similar manner to FIGS. 8 to 10, submitted data is to include the gold and silver leaf images, and the boundary is to correspond to the center line that divides the sheet into two in a width direction that is vertical with respect to the sheet forwarding direction. However, the present invention is not limited to the condition described above.

When the print job is first input to the controller 50, the input processing section 540 temporarily holds the print job in the submitted data holding section 541. Then, the analysis processing section 542 determines whether the print setting of the print data is set in the multiple imposition (S41). When it is not set in the multiple imposition (NO in S41), the processing is performed to proceed to step S1 in the flowchart including no multiple imposition illustrated in FIG. 8 (S63). Methods of checking whether the print data is set in the multiple imposition, include those, where print setting information is referred to, or the print data is scanned for each pixel.

On the other hand, when the analysis processing section 542 determines that the print setting of the print data is set in the multiple imposition (YES in S41), the processing in step S42 to step S45 is performed to generate the print data without leaves, the first print data for leaves, and the second print data for leaves. The processing in step S43 to step S45 is the same as that of step S1 to step S4 in FIG. 8.

Then, when the print data for leaves generating section 544 determines that generating the print data for leaves of all kinds of leaf images (in this example, the gold leaf image and the silver leaf image) has been completed in step S45 (YES in S45), the print data for leaves generated in step S44 is set in the multiple imposition based on the print setting information (S46).

Then, the stride-over determining section 545 extracts the position of the leaf object from each print data set in the multiple imposition (S47).

Then, the stride-over determining section 545 determines whether or not there is a leaf object striding over the center (boundary C) of the sheet in the extracted leaf object (S48).

(Case when there is Leaf Object Striding Over Boundary)

The explanation returns to FIG. 23. Next, when there is no leaf object striding over the center (boundary C) of the sheet included in the print data for leaves set in the multiple imposition (NO in S48), the stride-over determining section 545 proceeds to processing in step S49. On the other hand, when there is a leaf object striding over the center of the sheet, the imposition arrangement is changed, and the image shift or the image rotation is performed so that the leaf object does not stride over the center of the sheet.

Then, processing in step S49 to step S53 is performed. The processing in step S43 to step S45 is the same as that in step S7 to step S11 in FIG. 8.

Then, after the processing in step S53 is ended, the processing in step S54 to step S62 in FIG. 24 is performed. The print processing of the print data without leaves and the leaf pressing processing of print data of two kinds of leaves are performed. The processing in step S54 to step S62 is the same as that in step S12 to step S20 in FIG. 8. When the processing in step S62 is ended, the CPU 51 ends the submitted data processing.

By the above-described submitted data processing, even when two or more kinds of leaf objects are dotted in the leaf image set in the multiple imposition all over the image in the submitted data, the leaf pressing machine mounting the plurality of leaf rolls can perform the leaf pressing print of two or more kinds of leaves without replacing the leaf rolls.

(Case when there is Leaf Object Striding Over Boundary)

Next, the explanation returns to FIG. 23, and the processing when there is a leaf object striding over the center (boundary C) of the sheet included in the print data for leaves that is set in the multiple imposition, will be described.

When there is a leaf object striding over the center (boundary C) of the sheet in the leaf image in the print data for leaves in step S48 (YES in S48), the stride-over determining section 545 proceeds to processing in step S65 in FIG. 25.

Then, the stride-over determining section 545 performs scrutiny and determination processing on the leaf object striding over the center of the sheet after the image is shifted (S65, S66). Then, the stride-over determining section 545 performs scrutiny and determination processing on the leaf object striding over the center of the sheet after the image is rotated (S67, S68). The processing in step S65 to step S68 is the same as that in step S22 to step S25 in FIG. 8.

Then, the stride-over determining section 545 performs the image processing for changing imposition arrangement of (entire image including) the gold leaf image and the silver leaf image by the image adjusting section 547 to scrutinize whether the leaf object no more strides over the center (boundary C) of the sheet (S69).

Then, the stride-over determining section 545 determines whether or not the leaf object can avoid striding over the center of the sheet by changing the imposition arrangement (S70). When the leaf object can avoid striding over the center of the sheet (YES in S70), the processing proceeds to step S49, and the dividing, the telescopically combination and the like are performed on each leaf image of each print data for leaves after the image is adjusted.

On the other hand, when the leaf object cannot avoid striding over the center of the sheet (NO in S70), the processing proceeds to step S71, and the conventional print method is performed (S71 to S74). The processing in step S71 to step S74 is the same as that in step S26 to step S29 illustrated in FIG. 8. When it is determined that the leaf pressing of the all leaf image (first and second print data for combined leaves) has been completed in step S74 (YES in S74), the CPU 51 ends the submitted data processing.

[Creating Processing of Print Data for Leaves in Multiple Imposition]

Figure 26:
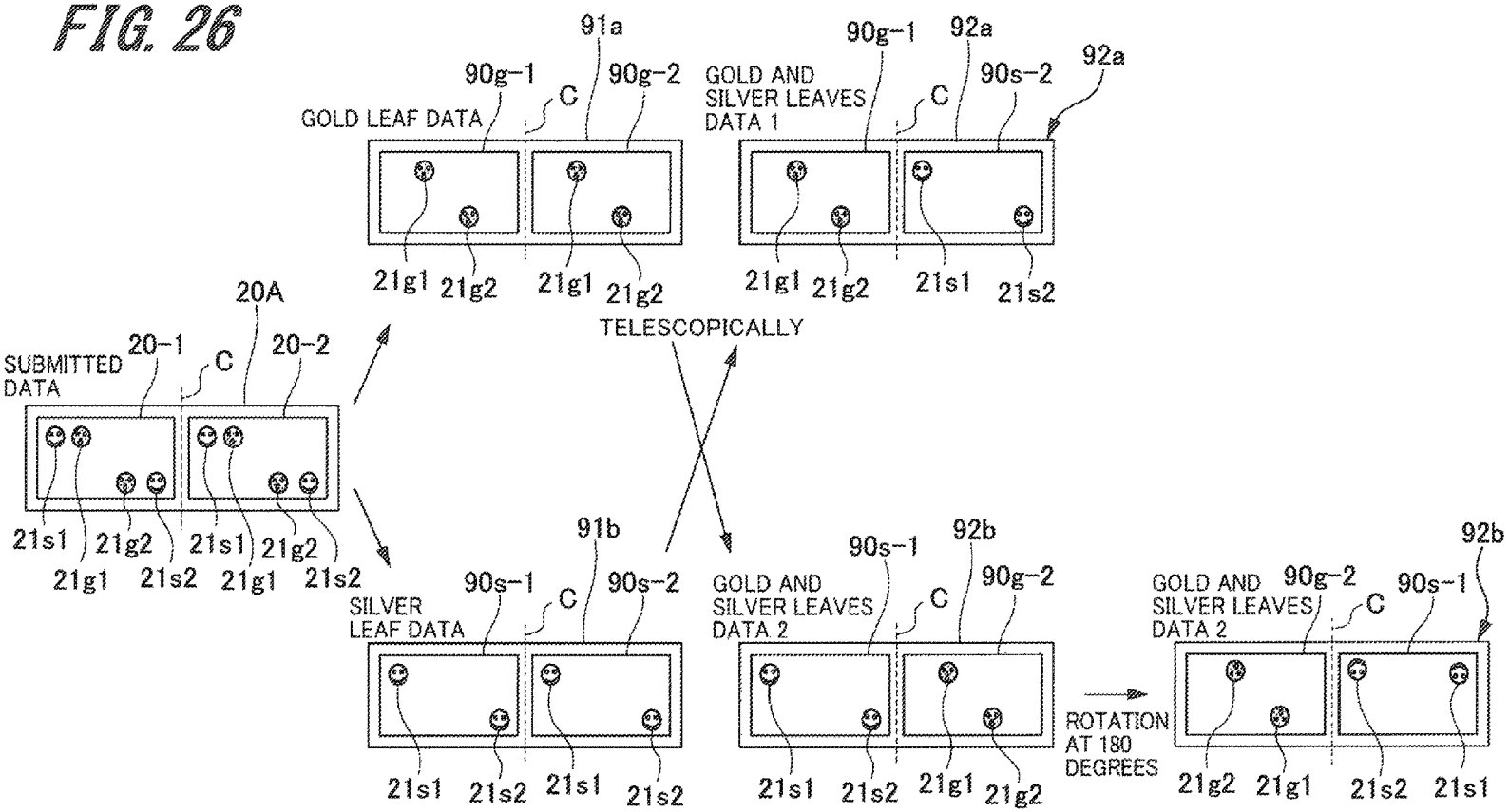
FIG. 26 illustrates a method of creating a first print data for leaves and a second print data for leaves from submitted data for multiple imposition according to the third embodiment of the present invention.

FIG. 26 illustrates a method of creating the first print data for combined leaves and the second print data for combined leaves from submitted data in multiple imposition according the third embodiment.

Print data for two pages, print data 20-1 and print data 20-2, are laid out for right and left portions of one page, in the submitted data 20A. Respective leaf objects of the print data 20-1 and the print data 20-2 do not stride over the center (boundary C) of the sheet.

Print data 91*a* for leaves for the gold leaf (gold leaf data: first print data for leaves) and print data 91*b* for leaves for the silver leaf (silver leaf data: second print data for leaves) are first generated from the submitted data 20A. In print data 91*a* for leaves for the gold leaf, two gold leaf images 90*g*-1 and 90*g*-2 each including only gold leaf objects are set in imposition. In print data 91*b* for leaves for the silver leaf, two silver leaf images 90*s*-1 and 90*s*-2 each including only silver leaf objects are set in imposition.

Then, the right-side divided leaf image (gold leaf image 90*g*-2) of the divided leaf images (gold leaf images 90*g*-1 and 90*g*-2) in the print data 91*a* for leaves for the gold leaf is replaced with the right-side divided leaf image (silver leaf image 90*s*-2) of the divided leaf images (silver leaf images 90*s*-1 and 90*s*-2) in the print data 91*b* for leaves for the silver leaf (to combine telescopically) to create first print data 92*a* (data 1 of gold and silver leaves) for combined leaves in which the gold leaf image 90*g*-1 and the silver leaf image 90*s*-2 have been set imposition, and second print data 92*b* (data 2 of gold and silver leaves) for combined leaves in which the silver leaf image 90*s*-1 and the gold leaf image 90*g*-2 have been set in imposition. Finally, the second print data 92*b* for combined leaves is rotated at 180 degrees.

As understood from FIG. 26, even in the submitted data including the images set in the multiple imposition, the leaf object can avoid striding over the boundary. Even when two or more kinds of leaf objects are dotted allover the image in the submitted data, the leaf pressing print can be performed without replacing the leaf rolls.

<4. Fourth Embodiment>

Next, as the fourth embodiment, an example in a case where the leaf pressing machine mounts three leaf rolls, will be described.

Figure 27:
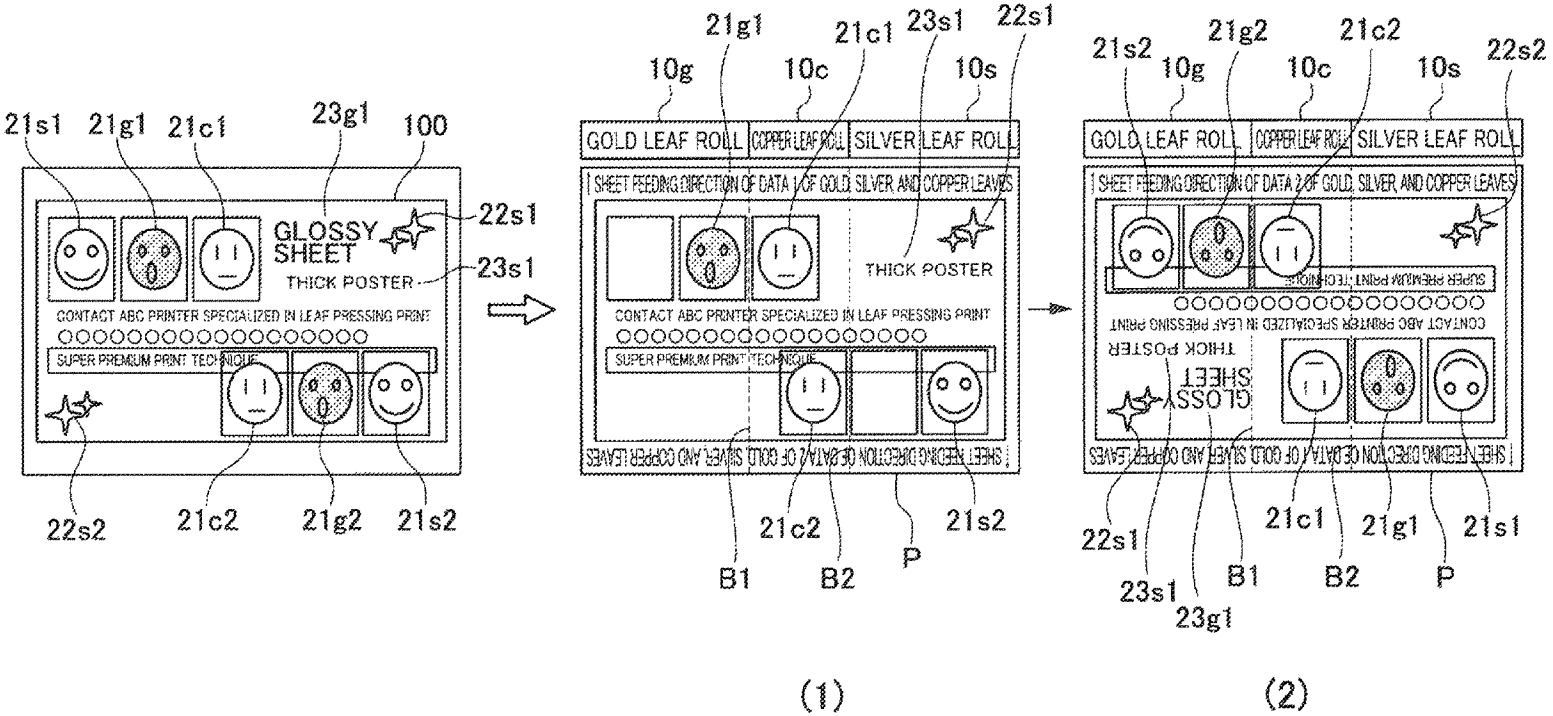
FIG. 27 illustrates an example of leaf pressing processing performed by a leaf pressing machine mounting three leaf rolls according to a fourth embodiment of the present invention.

FIG. 27 illustrates an example of leaf pressing processing performed by a leaf pressing machine mounting three leaf rolls according to the fourth embodiment.

As illustrated in FIG. 27, the leaf pressing machine mounts the gold leaf roll 10*g*, the silver leaf roll 10*s*, and a copper leaf roll 10*c*. An image 100 in the print data to be leaf-pressed includes gold leaf objects (21*g*1, 21*g*2, 23*g*1), silver leaf objects (21*s*1, 21*s*2, 22*s*1, 22*s*2, 23*s*1), and copper leaf objects (21*c*1, 21*c*2).

The leaf objects in the image 100 stride over none of boundaries B1 and B2 located among the above-described three leaf rolls. Therefore, as illustrated in FIG. 27 (1), by the leaf pressing processing for the first time, the gold leaf object 21*g*1, the silver leaf objects (21*s*2, 22*s*1, 23*s*1), and the copper leaf objects (21*c*1, 21*c*2) are leaf-pressed. Subsequently, as illustrated in FIG. 27 (2), by the leaf pressing processing for the second time, rest of gold leaf objects (21*g*2, 23*g*1), the silver leaf objects (21*s*1, 22*s*2, 23*s*1), and the copper leaf objects (21*c*1, 21*c*2) are leaf-pressed.

According to the present embodiment, even when three leaf rolls are used, if there is no leaf object striding over the boundary, two-time leaf pressing processing can complete the print. When three or more leaf rolls are necessary, there are two or more boundaries among the leaf rolls. Thus, it is necessary for all boundaries to check if there is an object striding over every boundary.

[Process of Submitted Data Processing Method]

Next, the submitted data processing when the leaf pressing machine mounts three leaf rolls, will be described.

Figure 28:
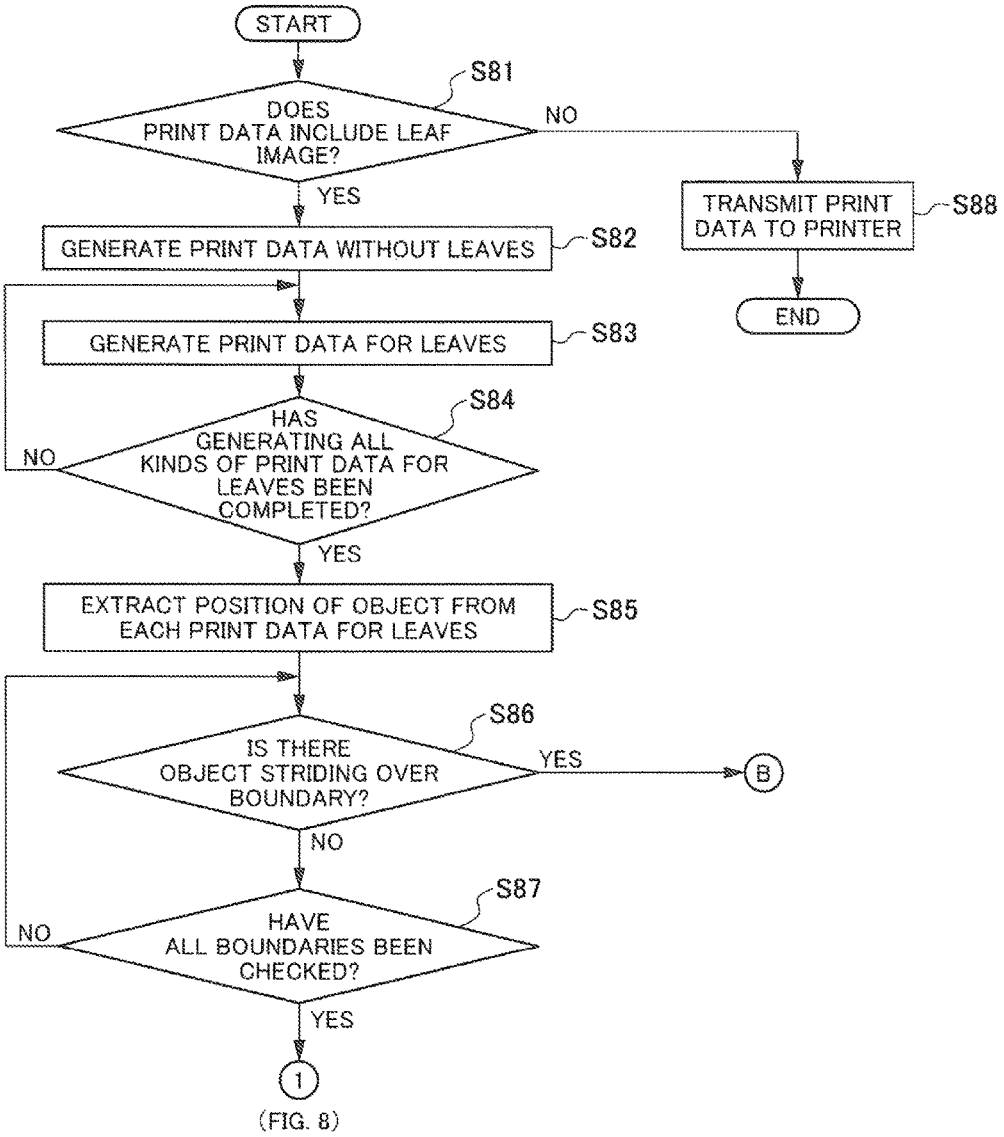
FIG. 28 is a flowchart illustrating a process (1) of a submitted data processing method according to the fourth embodiment of the present invention.
Figure 29:
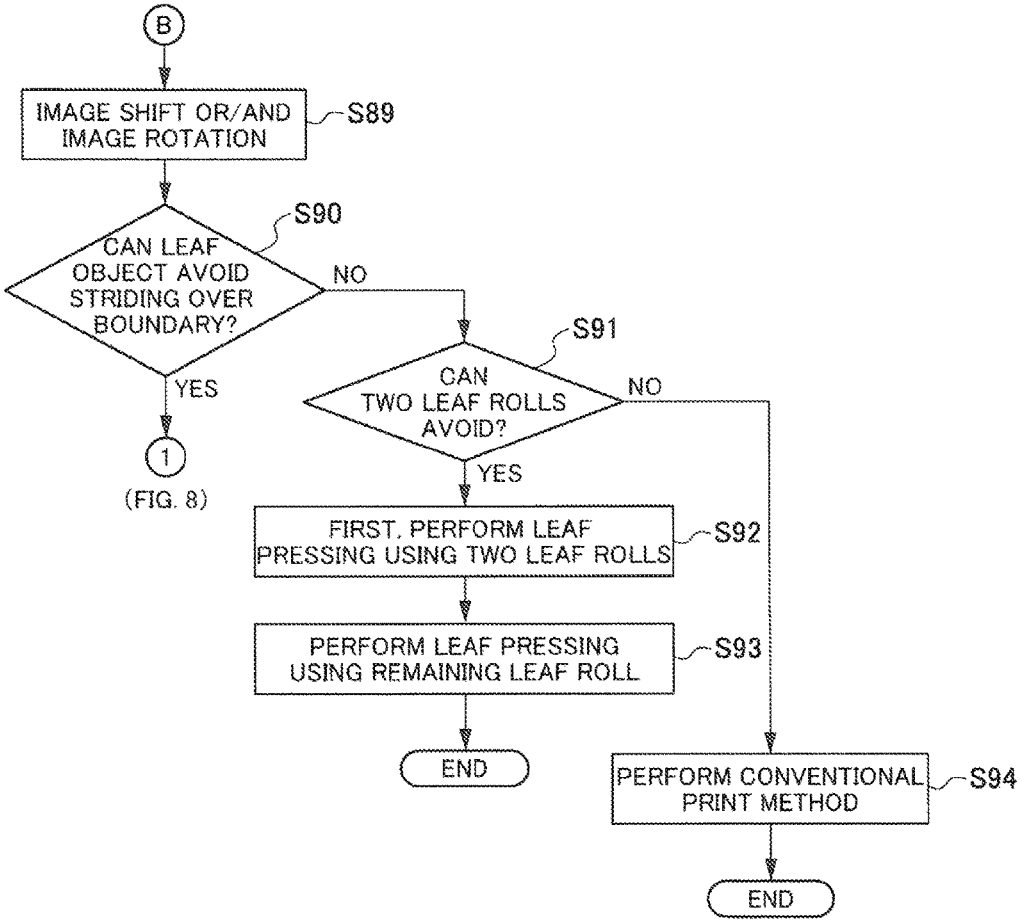
FIG. 29 is a flowchart illustrating a process (2) of the submitted data processing method according to the fourth embodiment of the present invention.

FIG. 28 is a flowchart illustrating a process (1) of a submitted data processing method according to the fourth embodiment. FIG. 29 is a flowchart illustrating a process (2) of the submitted data processing method according to the fourth embodiment.

When the print job is first input to the controller 50, the input processing section 540 temporarily holds the print job in the submitted data holding section 541. Next, the controller 50 performs processing in step S81 to step S85, and step S88. The processing performed in step S81 to step S85, and step S88 is the same as that in step S1 to step S5, and step S21 illustrated in FIG. 8.

Then, after the processing is performed in step S5, the stride-over determining section 545 determines whether or not there is a leaf object striding over the boundary B1 in the extracted leaf object (S86).

Figure 30:
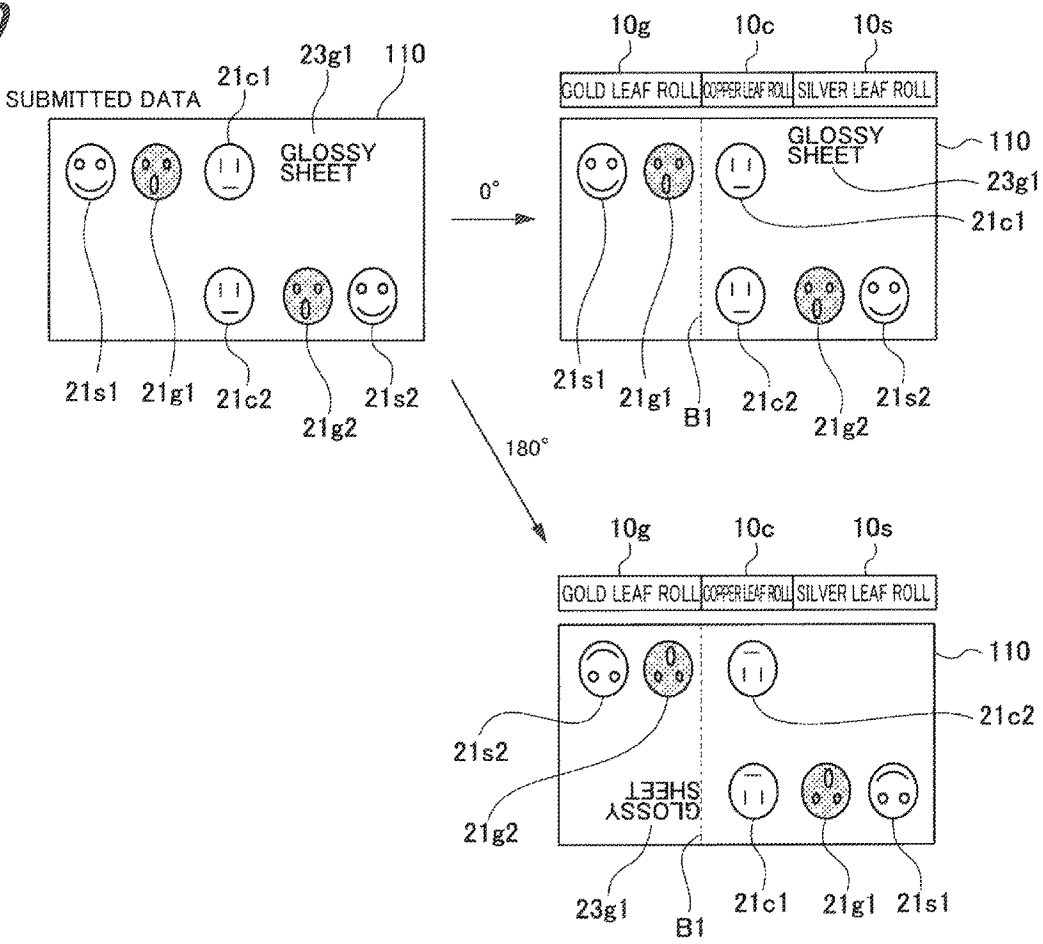
FIG. 30 illustrates a method (1) for determining whether there is a leaf object striding over a boundary according to the fourth embodiment of the present invention.

FIG. 30 illustrates a method (1) for determining whether there is a leaf object striding over a boundary according to the fourth embodiment.

The leaf image 110 in the submitted data is obtained by simplifying component of the leaf image in the image 100 in FIG. 27. First, the stride-over determining section 545 checks if there is a leaf object striding over the boundary B1. The leaf object is first checked in a state where the leaf image 110 is not rotated (0 degrees), and subsequently in a state where the leaf image 110 is rotated (180 degrees). When three leaf rolls are used, each boundary among the leaf rolls is not located at the center of the sheet. Thus, when the print data for combined leaves is generated by the submitted data processing of the present invention, check of processing in a normal state and in an inverted state is essential. In the example of FIG. 30, there is no leaf object striding over the boundary B1.

Then, when there is no leaf object striding over the boundary B1 in the leaf image in the print data for leaves (NO in S86), the stride-over determining section 545 determines for all boundaries whether or not it has been checked if there is a leaf object striding over every boundary (S87).

When the check has not been completed on all boundaries, or it has not been completed on some boundaries (NO in S87), the stride-over determining section 545 proceeds to step S86, and determines whether or not there is a leaf object striding over the next boundary B2 in the extracted leaf objects.

Figure 31:
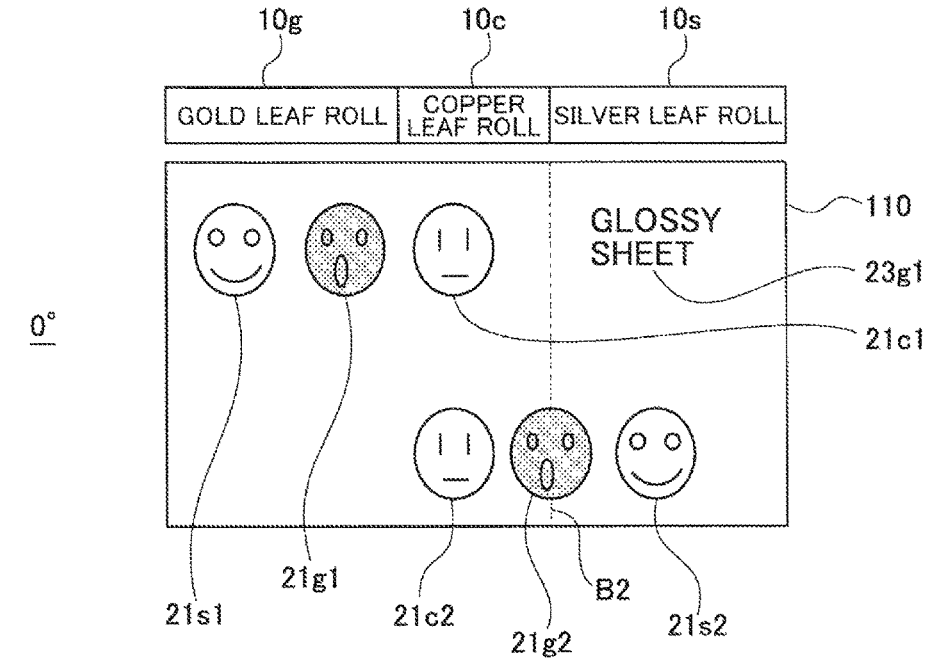
FIG. 31 illustrates a method (2) for determining whether there is a leaf object striding over the boundary according to the fourth embodiment of the present invention.
Figure 31:
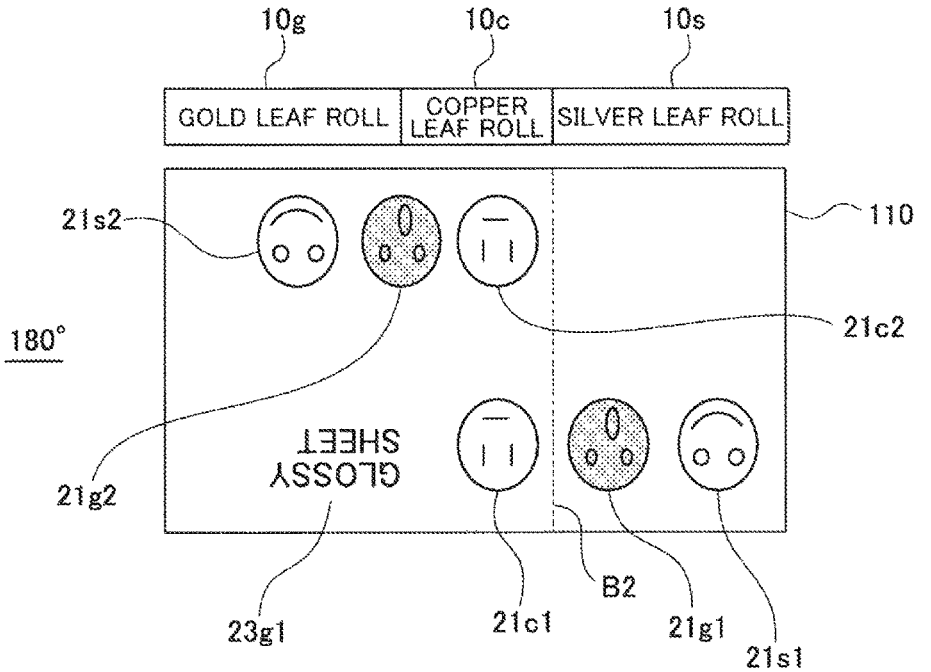

FIG. 31 illustrates a method (2) for determining whether there is a leaf object striding over the boundary according to the fourth embodiment.

In a similar manner to a case of the boundary B1, the stride-over determining section 545 checks first if there is a leaf object striding over the boundary B2 in a state where the leaf image 110 is not rotated (0 degrees). Subsequently, the stride-over determining section 545 checks it in a state where the leaf image 110 is rotated (180 degrees). In the example in FIG. 31, the gold leaf object 21*g*2 strides over the boundary B2 in a state where the leaf image 110 is not rotated (0 degrees). In this case, the image shift or/and image rotation described below is performed on the leaf image 110.

Subsequently, when it is determined whether or not it has been checked on all boundaries if there is a leaf object striding over every boundary in step S87 again, and when the check has been completed on all boundaries (YES in S87), the processing proceeds to step S7 in FIG. 8 to perform dividing, telescopically combining, and the like.

On the other hand, in step S86, when there is a leaf object striding over the boundary in the leaf image in the print data for leaves (YES in S86), the stride-over determining section 545 proceeds to processing in step S89 in FIG. 29.

Next, the print data for combined leaves generating section 546 performs the image shift or/and the image rotation so that the leaf object does not stride over the boundary (S89). The processing is the same as that in step S22 and step S24.

Then, the stride-over determining section 545 determines whether or not a leaf object can avoid striding over the leaf object by performing the image shift or/and the image rotation (S90). Here, when the leaf object can avoid striding over the boundary (YES in S90), the processing proceeds to step S7 in FIG. 8.

On the other hand, when the leaf object cannot avoid striding the boundary (NO in S90), it is determined whether the leaf object can avoid striding over the boundary using two leaf rolls (S91). Here, when the leaf object can avoid striding over the boundary using two leaf rolls (YES in S91), the print data for combined leaves generating section 546 generates the print data for combined leaves corresponding to the two leaf rolls, and outputs it to the output processing section 549. Further, the attached-information-image combining section 548 combines the image of attached information with the print data without leaves. Then, the print data without leaves and the print data for combined leaves including the corresponding leaves are transmitted from the controller 50 to the printer 60 and the leaf pressing machine 70 to perform the print processing and leaf pressing (S92).

Subsequently, the print data for combined leaves generating section 546 performs the leaf pressing using the above-described two leaf rolls and, then, generates the print data for combined leaves for the rest of the leaf. Then, the leaf pressing machine 70 performs the leaf pressing using the rest of the leaf roll (S93).

On the other hand, when the stride-over determining section 545 determines that the leaf object cannot avoid striding over the boundary even if using the two leaf rolls in step 91 (NO in S91), the CPU 51 performs the conventional print method (S94). When the processing in step S93 or step S94 is finished, the submitted data processing is ended.

As described above, when the leaf pressing is performed using three or more kinds of leaves, three or more leaf rolls are first set in the leaf pressing machine 70, and it is scrutinized whether the leaf pressing can be performed at a time. Then, when the leaf pressing cannot be performed at a time, the imposition and the order of the leaf pressing are controlled to replace the leaf rolls a minimum number of times.

<5. Fifth Embodiment>

According to the above-described embodiment, when two of the print data for leaves are generated, the image in one of the print data for leaves is rotated at 180 degrees. Here an example of rotation at an angle other than 180 degrees will be described.

Figure 32:
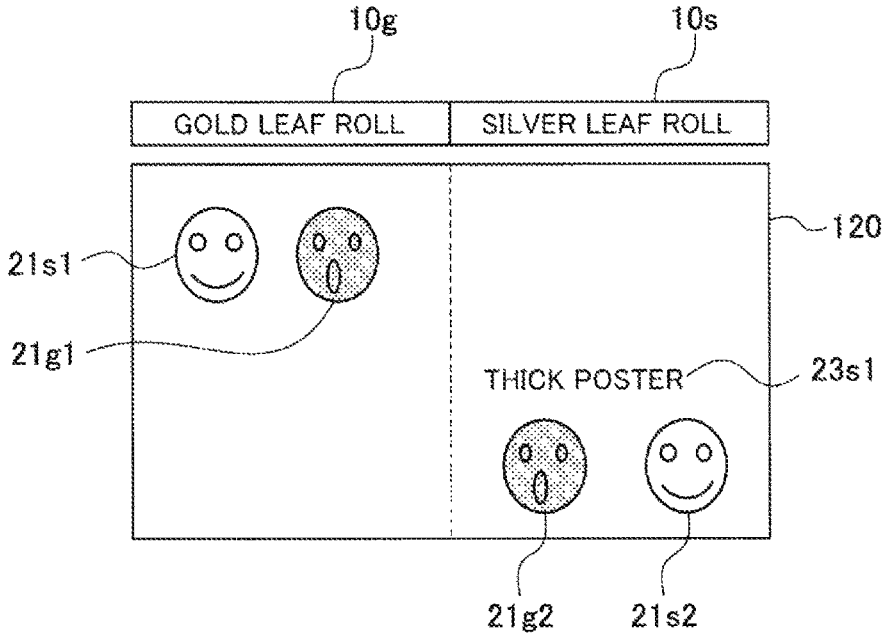
FIG. 32 illustrates an example of a leaf image in submitted data according to a fifth embodiment of the present invention.

FIG. 32 illustrates an example of a leaf image in the submitted data according to the fifth embodiment.

The submitted data 120 includes the gold leaf object 21*g*1 and the silver leaf object 21*s*1 on the left side of the center (dotted line portion) of the image, and the gold leaf object 21*g*2 and the silver leaf object 21*s*2, 23*s*1 on the right side of the center of the image. The gold leaf roll 10*g* and the silver leaf roll 10*s* are set in the leaf pressing machine 70.

Figure 33:
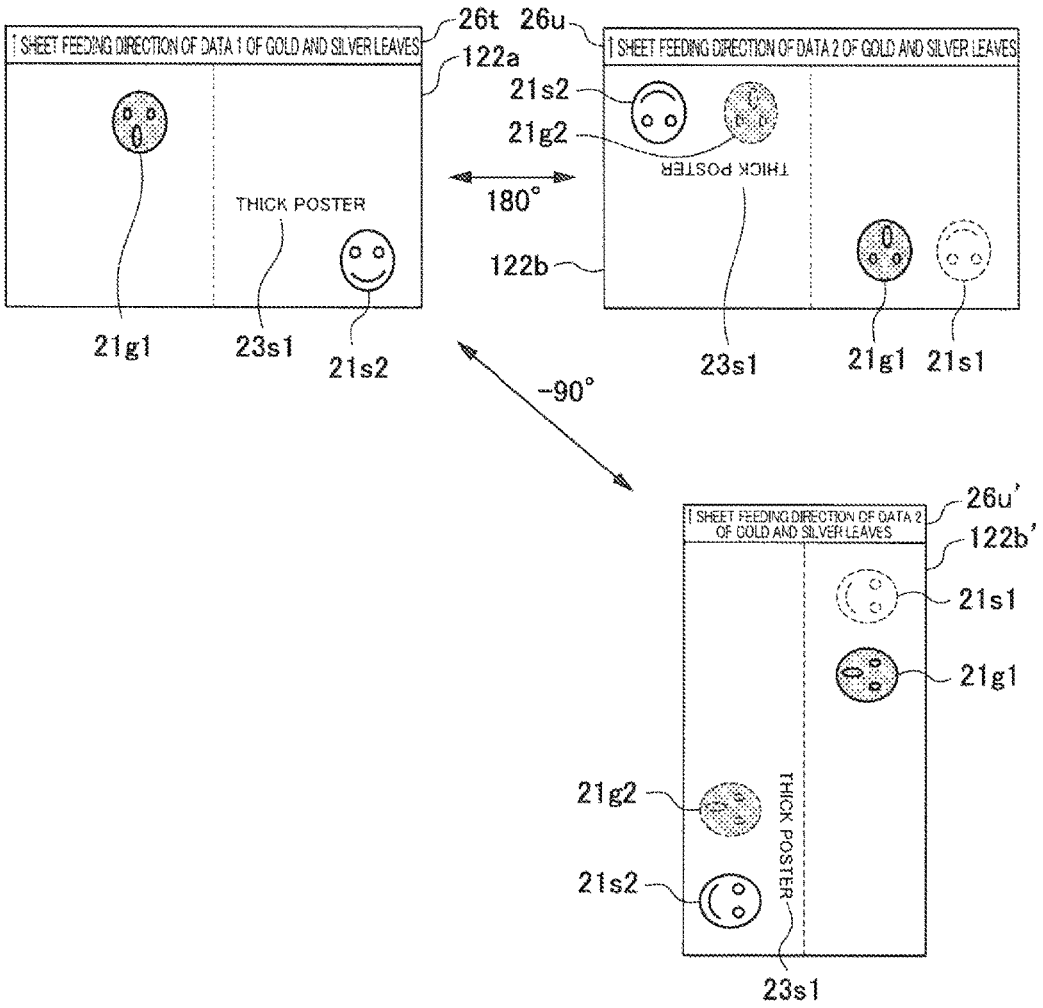
FIG. 33 illustrates an example of a rotation angle of the leaf image included in print data for leaves according to the fifth embodiment of the present invention.

FIG. 33 illustrates an example of a rotation angle of the leaf image included in the print data for leaves according to the fifth embodiment.

As illustrated in FIG. 33, first combination and second combination can be considered out of the submitted data 120. The first combination includes the first print data 122*a* for combined leaves and the second print data 122*b* for leaves, and the second combination includes the first print data 122*a* for combined leaves and the second print data 122*b*' for leaves. In the first combination, the second print data 122*b* for leaves is rotated at 180 degrees. On the other hand, in the second combination, the second print data 122*b*' for leaves is rotated at 90 degrees (−90 degrees). In the second combination, the leaf image in the second print data 122*b*' for leaves is longitudinally long and, thus, information of "↑sheet feeding direction of data 2 of gold and silver leaves" is formed on the cutting region 26*u*' provided in a lateral direction of the leaf image. Even in the above-described construction, since the leaf object does not stride over the center of the sheet, the leaf pressing processing of the present invention can be applied.

<6. Others>

Note that, according to the above-described first to fifth embodiments, the examples are described in which the print data without leaves and the print data for leaves in each color are generated from the submitted print data to the controller 50, but the print data is not essential. The present invention can be performed by submitting the image data of leaves for generating the print data for leaves in each color to the controller 50 (submitted data processing section 54). Further, the present invention can be also performed by submitting the print data for leaves in each color to the controller 50 (submitted data processing section 54).

Furthermore, although the client terminal 30 generates the print job including the print setting information and the submitted data (print data), and transmits them to the controller 50, the controller 50 may generate the submitted data.

Further, the print data for leaves in each color corresponding to the leaf roll also may be generated by the leaf pressing machine 70.

Furthermore, according to the above-described first to fifth embodiments, the controller 50 generates the print data without leaves and the print data for leaves in each color, and transmits them to the printer 60 and the leaf pressing machine 70. However, the present invention is not limited to those examples. For example, the function of the controller 50 may be applied to the printer 60, and the printer 60 may also have the function of the controller 50.

Further, the present invention is not limited to each embodiment described above. Needless to say, various kinds of applications and modifications may be made without departing from the scope of the invention set forth in claims.

For example, the construction of the devices and the systems are specifically described in detail for easier understanding of the present invention in the above-described embodiments. Therefore, all the constructions described above are not limited to be included. Further, a part of construction of one embodiment can be replaced with that of other embodiment. Furthermore, construction of one embodiment can be added to that of other embodiment. Moreover, other construction can be added to, deleted from, and replaced with a part of the construction of each embodiment.

Further, a part or all of the above-described construction, function, processing section, processing method, and the like, can be realized with hardware by, for example, designing an integrated circuit. Furthermore, the above-described construction, function, and the like, may be realized with software by interpreting and performing a program for realizing each function by a processor. Information such as a program, a table, and a file for realizing each function can be stored in a recording device such as a memory, a hard disk, and an SSD (solid state drive), or a recording medium such as an IC card, an SD card, and a DVD.

In addition, a control line and an information line that are considered to be essential for description, are described. All products do not always need the control line and the information line. It can be considered that actually most constructions are connected with each other.

Additionally, in the present specification, the processing step describing the processing in chronological order includes the processing performed in chronological order along the described order, and also the processing performed individually or in a parallel manner, even though it is not necessarily performed in chronological order (e.g., parallel processing or processing performed by an object).

Although the present invention has been described and illustrated in detail, it is clearly understood that the same is by way of illustrated and example only and is not to be taken by way limitation, the scope of the present invention being interpreted by terms of the appended claims.

REFERENCE SIGNS LIST

10*g* gold leaf roll
10*s* silver leaf roll
10*c* copper leaf roll
20 submitted data
21*g*1, 21*g*2 gold leaf object
21*s*1, 21*s*2 silver leaf object
22*s*1, 22*s*2 silver leaf object
23*g*1 gold leaf object (character)
23*s*1 silver leaf object
25N print data without leaves
25G first print data for leaves
25S second print data for leaves
26*t*, 26*u* cutting region
27, 28 image
30 client terminal
31 submitted data
40 print system
41 print data without leaves
42*a* first print data for combined leaves
42*b* second print data for combined leaves
50 controller (information processor)
51 CPU
54 submitted data processing section
60 printer
70 leaf pressing machine
76 first-leaf-pressing processing section
77 second-leaf-pressing processing section
80, 80A to 80C, print data
81 image
81*r* rotated image
544 print data for leaves generating section
545 stride-over determining section
546 print data for combined leaves generating section
547 image adjusting section
548 attached-information-image combining section
C boundary
Ci center of leaf image
Cr center point
D1, D2 attached information
M match mark
P sheet

What is claimed is:

1. An information processing equipment comprising a processor functioning as:

a stride-over determining section configured to extract leaf objects from first print data for leaves including a first leaf image in only a first color and second print data for leaves including a second leaf image in only a second color that are usable by a leaf pressing machine in which a first leaf roll in the first color and a second leaf roll in the second color are arranged adjacent to each other in a vertical direction with respect to a sheet forwarding direction of the leaf pressing machine, and determine whether or not any one of the extracted leaf objects strides over a boundary between a first region associated with the first leaf roll and a second region associated with the second leaf roll; and a print data for combined leaves generating section configured to, when the stride-over determining section determines that there is no leaf object striding over the boundary, perform processing for dividing each of the first leaf image and the second leaf image at the boundary, combining a first divided portion of the first leaf image with a first divided portion of the second leaf image to generate a first combined-leaves image, combining a second divided portion of the first leaf image with a second divided portion of the second leaf image to generate a second combined-leaves image, rotating the second combined-leaves image at a predetermined angle, generating first print data for combined leaves for the first combined-leaves image, and generating second print data for combined leaves for the rotated second combined-leaves image, wherein the processor is configured to output the first print data for combined leaves for use by the leaf pressing machine in a first pressing process to press on a sheet the first divided portion of the first leaf image with the first leaf roll in the first color and the first divided portion of the second leaf image with the second leaf roll in the second color, and output the second print data for combined leaves for use by the leaf pressing machine to press on the sheet, having been subjected to the first pressing process, the second divided portion of the first leaf image with the first leaf roll in the first color and the second divided portion of the second leaf image with the second leaf roll in the second color.

2. The information processing equipment according to claim 1, further comprising:

a leaf image adjusting section configured to, when the stride-over determining section determines that there is a leaf object striding over the boundary, perform image processing for changing positions of the first leaf image and the second leaf image so that the leaf object striding over the boundary no more strides over the boundary.

3. The information processing equipment according to claim 2, wherein the leaf image adjusting section performs image processing for moving the first leaf image and the second leaf image in a vertical direction with respect to the boundary.

4. The information processing equipment according to claim 2, wherein the leaf image adjusting section performs image processing for rotating the first leaf image and the second leaf image.

5. The information processing equipment according to claim 2, wherein the leaf image adjusting section performs image processing, after the first leaf image and the second leaf image are moved in the vertical direction with respect to the boundary, for rotating the first leaf image and the second leaf image.

6. The information processing equipment according to claim 4, wherein an angle at which the leaf image adjusting section rotates the leaf image is an angle at which a size of the sheet becomes minimum in angles at which the leaf image does not stride over the boundary.

7. The information processing equipment according to claim 1, wherein the boundary corresponds to a center line dividing the sheet into two in a width direction that is vertical with respect to the sheet forwarding direction.

8. The information processing equipment according to claim 1, wherein the stride-over determining section determines whether or not there is a leaf object striding over the boundary, when the center line dividing the sheet into two in the width direction that is vertical with respect to the sheet forwarding direction does not correspond to the boundary, in a state where each of the first leaf image and the second leaf image is not rotated, and also in a state where each of the first leaf image and the second leaf image is rotated at an angle of 180 degrees.

9. The information processing equipment according to claim 1, wherein the predetermined angle is 180 degrees or 90 degrees.

10. The information processing equipment according to claim 2, wherein the leaf image adjusting section performs, when the page layout setting of the first leaf image and the second leaf image is set in multiple imposition, image processing for changing positions of the first leaf image and the second leaf image that are multiple imposed so that the leaf object striding over the boundary in each leaf image to be multiple imposed no more strides over the boundary.

11. The information processing equipment according to claim 1, further comprising:

a print data without leaves generating section configured to generate print data without leaves that is obtained by excluding the first leaf image and the second leaf image from submitted print data received by the information processing equipment, and a print data for leaves generating section configured to generate the first print data for leaves including the first leaf image and the second print data for leaves including the second leaf image from the submitted print data.

12. The information processing equipment according to claim 11, further comprising;

an attached-information-image combining section configured to, when a positioning image for performing leaf pressing processing by the leaf pressing machine is applied as attached information in a region corresponding to a cutting region at a leading end side of the sheet in the sheet feeding direction in the print data without leaves, apply the positioning image at a corresponding position in a sheet feeding direction when leaf pressing processing is performed each on the first print data for leaves and the second print data for leaves.

13. The information processing equipment according to claim 12;

wherein the attached-information-image combining section is configured to apply information indicating a sheet feeding direction and a sheet feeding order of the sheet so as to correspond to an order of each leaf pressing processing of the first print data for leaves and the second print data for leaves in a region corresponding to a cutting region at a leading end side of the sheet in the sheet feeding direction in the print data without leaves.

14. The information processing equipment according to claim 1;

wherein the leaf pressing machine further comprises a third leaf roll in a third color arranged adjacent to the first leaf roll and the second leaf roll in a vertical direction with respect to the sheet forwarding direction;

wherein the print data for leaves generating section generates a third print data for leaves including a third leaf image including only leaf object in the third color from submitted print data received by the information processing equipment;

wherein the stride-over determining section extracts a leaf object included in a leaf image in each color in the first print data for leaves, the second print data for leaves, and the third print data for leaves including the third leaf image including only the leaf object in the third color, and determines whether or not there is a leaf object striding over the boundary where the leaf pressing processing in each color is performed, and also determines whether or not the leaf pressing processing is capable of being performed at a time using each leaf roll in each of the first, second, and third colors, and wherein, when the stride-over determining section determines that the leaf pressing processing is not capable of being performed at a time using the leaf roll in each color, imposition of each leaf image and an order of leaf pressing are controlled so that the leaf roll is replaced minimum number of times.

15. A non-transitory computer-readable recording medium storing a program, which when executed by a computer, causes the computer to perform a process comprising:

generating, from submitted data, first print data for leaves including a first leaf image in only a first color and second print data for leaves including a second leaf image in only a second color that are usable by a leaf pressing machine in which a first leaf roll in the first color and a second leaf roll in the second color are arranged adjacent to each other in a vertical direction with respect to a sheet forwarding direction of the leaf pressing machine;

extracting leaf objects from first print data for leaves and the second print data for leaves, and determining whether or not any one of the extracted leaf objects strides over a boundary between a first region associated with the first leaf roll and a second region associated with the second leaf roll;

performing, upon determining that there is no leaf object striding over the boundary, processing for dividing each of the first leaf image and the second leaf image at the boundary, combining a first divided portion of the first leaf image with a first divided portion of the second leaf image to generate a first combined-leaves image, combining a second divided portion of the first leaf image with a second divided portion of the second leaf image to generate a second combined-leaves image, rotating the second combined-leaves image at a predetermined angle, generating first print data for combined leaves for the first combined-leaves image, and generating second print data for combined leaves for the rotated second combined-leaves image;

outputting the first print data for combined leaves for use by the leaf pressing machine in a first pressing process to press on a sheet the first divided portion of the first leaf image with the first leaf roll in the first color and the first divided portion of the second leaf image with the second leaf roll in the second color; and outputting the second print data for combined leaves for use by the leaf pressing machine to press on the sheet, having been subjected to the first pressing process, the second divided portion of the first leaf image with the first leaf roll in the first color and the second divided portion of the second leaf image with the second leaf roll in the second color.

* * * * *